US010981704B2

(12) United States Patent
Crawley

(10) Patent No.: US 10,981,704 B2
(45) Date of Patent: Apr. 20, 2021

(54) ONE-HANDED CLOSURE FOR PRESSURIZED HEADSPACE BEVERAGES

(71) Applicant: Alan Mark Crawley, Blenheim (NZ)

(72) Inventor: Alan Mark Crawley, Blenheim (NZ)

( * ) Notice: Subject to any disclaimer, the term of this patent is extended or adjusted under 35 U.S.C. 154(b) by 85 days.

(21) Appl. No.: 16/073,426

(22) PCT Filed: Jan. 27, 2017

(86) PCT No.: PCT/IB2017/050430
§ 371 (c)(1),
(2) Date: Jul. 27, 2018

(87) PCT Pub. No.: WO2017/130142
PCT Pub. Date: Aug. 3, 2017

(65) Prior Publication Data

US 2019/0031406 A1 Jan. 31, 2019

(30) Foreign Application Priority Data

Jan. 29, 2016 (NZ) ..... 716521

(51) Int. Cl.
*B65D 47/24* (2006.01)
*B65D 47/26* (2006.01)
(Continued)

(52) U.S. Cl.
CPC ..... *B65D 47/243* (2013.01); *B65D 47/265* (2013.01); *B65D 47/286* (2013.01);
(Continued)

(58) Field of Classification Search
CPC .. B65D 47/243; B65D 47/265; B65D 47/286; B65D 47/30; B65D 51/1683; B65D 47/08
See application file for complete search history.

(56) References Cited

U.S. PATENT DOCUMENTS 4,890,637 A * 1/1990 Lamparter ..... B65D 77/225 137/246
2004/0065635 A1* 4/2004 Turnbough ..... A47G 21/145 215/11.1

(Continued)

FOREIGN PATENT DOCUMENTS

CN 103224087 A 7/2013

OTHER PUBLICATIONS

Machine translation of CN 103224087 provided by Espacenet. (Year: 2020).*

*Primary Examiner* — James N Smalley
(74) *Attorney, Agent, or Firm* — Laubscher & Laubscher, P.C.

(57) ABSTRACT

A pressurised headspace beverage closure 1 that may be opened and reclosed in at least substantially a one-handed manner; comprising a drinking aperture, at least one headspace pressure lock mechanism 5, at least one controlled-rate headspace pressure equalisation valve arrangement 6 and a sealing system 7 suitable for multiple re-use, and whereby when the headspace pressure 10 is at least substantially above or below atmospheric pressure the headspace pressure lock mechanism 5 may employ the use of the headspace pressure 10 itself to ensure that the closure cannot freely be opened by a user, whereby the headspace pressure equalisation valve arrangement 6 may freely enable the headspace pressure 10 to be vented such that it may at least substantially equalise with atmospheric pressure at a pre-set and controlled rate preferably independent of a user thereby allowing safe and controlled venting of the headspace pressure 10, and whereby once the headspace pressure 10 has at least substantially equalised with atmospheric pressure the headspace pressure interlock system 5 may release its headspace pressure lock sufficiently to enable the one-handed
(Continued)

closure to be fully and freely opened and reclosed as required.

12 Claims, 11 Drawing Sheets

(51) Int. Cl.
*B65D 47/28* (2006.01)
*B65D 47/30* (2006.01)
*B65D 51/16* (2006.01)
*B65D 47/08* (2006.01)

(52) U.S. Cl.
CPC ..... *B65D 47/30* (2013.01); *B65D 51/1683* (2013.01); *B65D 47/08* (2013.01)

(56) References Cited

U.S. PATENT DOCUMENTS

2005/0039416 A1* 2/2005 Hidding ..... B65D 1/023 53/397
2007/0034595 A1* 2/2007 Foster ..... B65D 50/043 215/330
2010/0181278 A1 7/2010 Martin

* cited by examiner

ONE-HANDED CLOSURE FOR PRESSURIZED HEADSPACE BEVERAGES

FIELD OF THE INVENTION

This invention relates to closures for pressurised headspace beverages whereby a user may safely open and reclose a closure for pressurised headspace beverage bottles with substantially one hand.

BACKGROUND

Whenever the words "pressure" or "pressurised" are used in this specification, they refer to where the pressure in the headspace of a beverage bottle is not at least substantially close to atmospheric pressure, and may equally be substituted with; carbonated, carbonation pressure, vacuum, headspace pressure, headspace vacuum, above atmospheric pressure, below atmospheric pressure, or any other derivative denoting a pressure that is not at least substantially close to atmospheric pressure apparent to those versed in the art.

There are many closure forms in the beverage market including but by no means limited to:

- standard screw cap closures,
- closures with the likes of push-pull and screw-top spouts,
- closures with integral self-sealing valves, and
- closures with integral straws where closing is effected through bending of a straw.

All of the above closures are effective when used in the myriad of non-pressurised beverage market sectors including the likes of iced teas, coffees and water.

In the pressurised beverage market sector however, typically only standard screw-cap closures are used, for reasons including:

- the difficulty in effectively sealing the bottle's internal headspace pressure over extended periods,
- for above atmospheric pressure headspace beverages, the tendency for many closures to open on their own accord when subjected to extended high internal headspace pressure,
- for below atmospheric pressure headspace beverages, the typical need for a separate pressure-seal membrane that must be ruptured/removed upon unscrewing the closure, and
- difficulty equalising the internal headspace pressure with atmospheric pressure in a safe and controlled manner prior to opening.

Above atmospheric pressure beverages may include the likes of carbonated beverages and sparkling wines, where the increase in headspace pressure in the bottle above atmospheric pressure once the bottle is seal-closed may be a result of natural effervescence in the beverage or pressurised gas added during bottling.

Below atmospheric pressure beverages may include the likes of energy drinks and juices, where the beverage may be bottled at above atmospheric temperature by hot-filling typically as a means of extending shelf-life, and where on the cooling of the beverage once sealed inside the bottle, a lower than atmospheric pressure headspace may form.

U.S. Pat. No. 6,474,515 teaches a vented closure for carbonated beverage applications. This concept is based on a twist-top spout with an intermediate "vent" position to release carbonation pressure and a fully open "drink" position for drinking.

This patent teaches the use of a twist-top spout to ensure the closure remains locked and sealed when in a closed position. The concept is for a user to twist the closure into a partially open "vent" position to allow the internal carbonation pressure to vent through a predefined pathway and then to further twist into a fully open "drink" position at which time the vent pathway is sealed.

This concept along with others included in prior art have significant practical drawbacks, particularly in the areas of:

- typically require the use of two hands or the like in order to both hold the bottle and twist the cap simultaneously,
- when in the "vent" position the carbonation vent path is of significantly large cross-sectional area to enable near-instantaneous pressure venting to occur which may promote effervescence, and
- allows a user to open the closure straight from the "closed" to the "drink" position, thereby bypassing whether intentionally or inadvertently the "vent" position and exposing a user to the release of significant carbonation pressure and the resulting effervescence.

Particularly when it is desired for a closure to be used in a one-handed situation, these drawbacks are of significant importance. When a one-handed closure is being used, as by example-only while operating a means of transportation, a significant and sustained release of effervescence might seriously distract the operator with potentially disastrous consequences.

The majority of screw-caps in the market today teach vented pathways to reduce the internal carbonation pressure sufficiently before the closure is fully removed, ensuring that the bottle headspace residual pressure does not dangerously propel the closure off of the bottle thread finish.

In all vent formats taught, including as taught in U.S. Pat. No. 6,474,515, the vent pathway is an unobstructed opening of significant cross-sectional area. The intent is to provide sufficient cross-sectional area to reduce the internal gas pressure as rapidly as possible, however while this is effective in reducing the internal pressure to atmospheric pressure quickly, none of these vent-pathways effectively deal with the generation of effervescence. In fact, all increase the likelihood and intensity of effervescence.

It is a popular misconception that a change of state in nature occurs instantaneously, as by example the belief that the voltage across a light bulb reduces instantaneously to zero when a switch is turned off, or the above atmospheric internal carbonation pressure in a beverage bottle reduces to atmospheric pressure instantaneously.

In reality, the effect of inducing a rapid change of state results in the generation of a myriad of third order harmonics. In the light bulb example, this is evidenced through electrical arcing across the switch and electrical noise generation.

In the example of carbonated beverages, this is evidenced by the generation of third order harmonic air pressure waves in the headspace gas which drive down into the beverage as third order pressure waves in the liquid, causing the further release of carbonation gas bubbles leading to an uncontrolled build up in the release of carbonated gas thereby resulting in a large effervescent discharge.

Whatever the example of this phenomenon in nature, the solution to at least substantially reduce the generation of such third-order harmonic effects is to introduce a control system to minimise the resulting third order harmonic generation. The simplest form of control system in such situations is to control the rate of change of state, which is known as a damped control system.

This leads to the other major issue in current prior art whereby a user at any time may over-ride or bypass the "vent" position and twist/open the closure straight into the "drink" position. Not only does this mean that at any time a user may bypass any vent mechanism, it also means that even if opened to "drink" inadvertently, dangerous effervescent release may result for a user without their prior anticipation.

A further issue to consider is that, upon rapid release of the carbonation pressure and the certain generation of effervescence this causes, the resulting additional release of carbonation pressure from the beverage unnecessarily reduces the residual carbonation levels in the beverage. By including a damped control system and removing as much as possible any effervescent release, residual carbonation pressure in the beverage may be maximised.

For below atmospheric pressure headspaces, third order harmonics are not usually an issue, rather the issue is how to raise the headspace vacuum created by hot filling until it is sufficiently close to atmospheric pressure in order to open the closure without the need to unscrew the closure and pull-free/rupture any hot-fill seal membrane.

In this specification where reference has been made to patent specifications, other external documents, or other sources of information, this is generally for the purpose of providing a context for discussing the features of the invention. Unless specifically stated otherwise, reference to such external documents or such sources of information is not to be construed as an admission that such documents or such sources of information, in any jurisdiction, are prior art or form part of the common general knowledge in the art.

The object of the present invention is to overcome some of the disadvantages with closures for pressurised beverage systems and provide a useful alternative choice.

SUMMARY OF THE INVENTION

The term "comprising" as used in this specification means "consisting at least in part of"; that is to say when interpreting statements in this specification which include "comprising", the features prefaced by this term in each statement all need to be present but other features can also be present. Related terms such as "comprise" and "comprised" are to be interpreted in similar manner.

In accordance with a first aspect of the present invention there is provided a closure for pressurised headspace beverages that may be opened and reclosed by a user in at least substantially a one-handed manner; comprising a drinking aperture, at least one headspace pressure lock mechanism, at least one controlled-rate headspace pressure equalisation valve arrangement, and a sealing system suitable for multiple re-use, and whereby while the headspace pressure is at least substantially above or below atmospheric pressure the headspace pressure lock mechanism may at least substantially employ the use of the headspace pressure itself to at least substantially ensure that the closure cannot readily be opened by a user, whereby the headspace pressure equalisation valve arrangement may enable the headspace pressure to be vented such that it may at least substantially equalise with atmospheric pressure preferably at a pre-set and controlled rate independent of a user thereby allowing safe and controlled venting of the headspace pressure, and whereby once the headspace pressure has at least substantially equalised with atmospheric pressure, the headspace pressure interlock system may release its headspace pressure lock sufficiently to enable the one-handed closure to be freely opened and reclosed as required by a user, thereby enabling a user to freely open the closure into a "drink" position and drink the beverage through the drinking aperture. For above atmospheric pressure beverages; once reclosed, any residual pressure in the beverage may lead to a re-build-up in pressure in the headspace such that the headspace pressure lock may once again at least substantially lock-closed the one-handed closure. A one-handed closure arrangement may have a headspace over-pressure relief valve mechanism in case headspace pressure rises above a pre-set maximum level. A one-handed closure arrangement may include tamper-evidence. A one-handed closure arrangement may include means of hygiene protection.

Within closures that have integral open/reclose means without the need to unscrew the closure from the bottle thread finish, there are any number of known ways to form an open/reclose drinking aperture, including but by no means limited to:

- a flip-top cover over a substantially wide drinking aperture,
- an integral tap, valve or spout that works at least substantially in the direction of open/reclose and incorporates a substantially narrow drinking aperture,
- an integral tap, valve or spout that works in a plane at least substantially perpendicular to the open/reclose direction and incorporates a substantially narrow drinking aperture,
- any combination of the above, or
- any other means of forming an open/reclose drinking aperture apparent to those versed in the art.

When headspace pressurise is applied to a flip-top cover arrangement incorporating a substantially wide drinking arrangement, there may be a tendency for the flip-top cover arrangement to open of its own accord if the internal headspace pressure is above atmospheric and to seal down tightly and resist opening if the internal headspace pressure is below atmospheric.

Within tap, valve or spout design used ubiquitously worldwide for controlling the flow of high pressure liquids and gases, one rarely finds formats similar to existing closures, that is taps, valves or spouts orientated in the direction of the applied pressure. Instead, one typically finds any number of variants with open/reclose mechanisms orientated at least substantially perpendicular to the direction of applied pressure.

Closures with push-pull spouts such as found on water bottles and the like open and reclose in the direction of the applied pressure and typically when a high internal headspace pressure is applied, they have a tendency to open on their own accord.

Taps, ball valves, rotary valves, sliding valves or screw-top spouts however typically slide, screw or rotate at least substantially perpendicular to the applied pressure and may have sealing surfaces optimised to be as small and clearly defined as practicable and therefore may have a significantly reduced tendency to open on their own accord.

A tap or valve design capable of being integrated into a closure can be of any number of formats known to those versed in the art, including but by no means limited to a:

- ball-valve on a round shaft that opens and recloses via a rotary shaft action,
- valve in a parallel-sided round shaft that opens and recloses via rotary action,
- sliding-valve of square, rectangular or circular cross-section that opens and recloses via a backwards and forwards sliding action,
- any combination of the above, or
- any other tap or valve format apparent to those versed in the art.

The open/reclose motion of a tap, valve or spout may be effected by any number of means, including but by no means limited to:

movement of an external lever, rotation of an external part of the closure with an integrated rack and pinion gear arrangement, rotation of an external part of the closure with an integral cam-based driving system, winding up and down of a spout utilising a thread as taught in U.S. Pat. No. 6,474,515, pushing directly down on to a button moving in a linear direction of motion, turning a wheel, knob or handle, any combination of the above, or any other means of tap, valve or spout open/reclose motion apparent to those versed in the art.

Market research by global beverage companies has long-established that for the likes of carbonated beverages, users prefer to "chug" their drinks; that is, users prefer drinking apertures to be as wide as possible.

The preferred drinking aperture for a one-handed closure arrangement capable of being opened and reclosed is a flip-top cover over a substantially wide drinking aperture.

Whatever the chosen method of forming a drinking aperture on a one-handed closure capable of being opened and reclosed for beverage drinking purposes, there remains the issues of:

ensuring that the closure arrangement remains sealingly closed and securely in place on the bottle thread-finish even under the effects of substantial headspace pressures, and controlled-rate venting of the headspace pressure in order to at least substantially reduce any effervescence that opening the closure may cause.

Whether a flip-top cap, tap, valve, screw-top or push-pull spout or the like is employed, there is nothing inherent in the design of current closures to ensure:

that the closure cannot readily be opened straight into the "drink" position, whether on purpose or inadvertently, while substantial pressure differences remain between the headspace pressure and atmospheric pressure, and the safe and controlled equalisation of headspace pressure with atmospheric pressure as part of a damped control system.

In order for a one-handed closure to vent the pressurised headspace in a safe and controlled manner, it is necessary to ensure that a user cannot readily open the closure straight from the "closed" into the "drink" position, whether purposefully or inadvertently, until such time as the pressurised headspace has at least substantially equalised with atmospheric pressure, and in order to achieve this, some form of closure "lock" or "interlock" arrangement is required. This is known as providing feedback loop control whereby the closure itself at least substantially inhibits a user from freely opening the closure into the "drink" position until such time as the headspace pressure has at least substantially equalised with atmospheric pressure.

Closures are typically mass-produced in enormous volumes, so it is imperative that any headspace pressure lock arrangement be as simple as possible. To effectively interlock a closure such that a user cannot readily or freely override any lock mechanism and place the closure in the "drink" position until the feedback control system determines it to be safe to do so requires a significant degree of lock-force. One solution is to employ the significant force exerted by the internal headspace pressure itself to effect the requisite lock, and only at such time as the internal headspace pressure has at least substantially equalised with atmospheric pressure will the headspace pressure lock release.

Any closure design with open/reclose means, whether incorporating any combination of flip-top, tap, value, screw-top or push-pull arrangement, of necessity requires closure sub-assembly parts to move with respect to each other in order to open into the "drink" position, and therefore any such moving-part action may be "jammed" or "locked".

For above atmospheric headspaces, one method of construction of a headspace pressure interlock system using the internal headspace pressure is the design of one or more features into the closure arrangement that flex or deflect in such a way under the build-up in headspace pressure such that the resulting deflection/movement "jams" or "locks" the opening mechanism of the closure arrangement.

Such "jamming" or "locking" may be effected by one or more features in a closure assembly that flex either inwards and/or outwards under applied headspace pressure. When internal headspace pressure builds up, the applied pressure on the flexible feature(s) move/flex/deflect them such that their movement/flexing/deflection relative to other closure component-parts causes one or more moving parts to "jam" or "lock", thereby at least substantially inhibiting a user from opening the closure while the headspace pressure lock is applied.

When the internal headspace pressure has reduced through safe and controlled venting to a predetermined pressure level close to atmospheric pressure, the flexible feature(s) may naturally return to their rest position and thereby free the headspace pressure lock thereby allowing a user to freely open the closure into the "drink" position.

The preferred means of achieving a headspace pressure lock is by combining plastic and thermosetting rubber features together such that the plastic feature(s) provide the lock strength and the thermosetting rubber feature(s) provide a spring-effect to enable the headspace pressure lock to move/flex/deflect under applied headspace pressure and return to a rest and "unlocked" position when applied headspace pressure has been substantially removed.

A headspace pressure lock arrangement may be created by one or more integral parts, such as by means of over-moulding one or more different materials into the closure construction, and/or by separate and individual parts of the same or alternate materials assembled together to form a composite closure headspace pressure lock arrangement.

For the construction of a headspace pressure lock arrangement, the preferred plastic is polypropylene, the preferred thermoset rubber is TPE or the like, and the preferred means of construction is by integrally over-moulding one or more materials together.

In order to achieve a damped control system in a one-handed closure, the headspace pressure must be vented through a small and defined aperture whereby pressure equalisation occurs at a rate slow enough to ensure minimal generation of third-order harmonic effects and thereby minimal generation of effervescence, and preferably at a pre-set rate independent of a user.

When considering the controlled rate of release equalisation of headspace pressure, even the vent pathways currently taught in prior art may provide insufficient dampening to minimise the effects of effervescence generation in all situations, hence an opening of very small cross-sectional area is typically required. Tests show that a vent aperture of less than 1 millimetre diameter (less than 40 thousandths of an inch diameter) is typically required to achieve the desired dampening effect, however dependent on the overall controlled rate of release headspace pressure equalisation valve arrangement design, vent aperture size may need to be larger or smaller than this. Whatever the controlled rate of release equalisation pressure vent size chosen however, the desire is to control the rate of pressure equalisation of headspace pressure with atmospheric pressure such that little if any effervescence is generated, and preferably at a rate of release independent of a user.

It is understood that in providing a controlled rate of release equalisation pressure vent of such small cross-sectional area, the venting time may be significantly longer than that as provided by vent-means currently taught, however when a user requires the usage of a one-handed closure, they are typically focused on other more important issues at-hand, such as operating a means of transportation or watching sport or the like, and the relative vent-time, while expected to be in the order of a few seconds rather than "near instantaneous" as per vent-methods currently taught, the vent-time for controlled rate of release equalisation pressure venting typically will be less than the time a user would take to unscrew then re-screw the closure onto a bottle thread finish.

There are two main issues regarding the construction of a controlled rate of release equalisation pressure vent:

- how to reliably achieve controlled rate release of headspace pressure at a release-rate preferably independent of a user, and
- how to readily seal and reseal the controlled rate of release headspace pressure vent.

For closure's, the volume of manufacture is typically enormous hence any such control system must of necessity be simple and easy to construct.

As already established, whatever the sub-assembly parts may be that comprise a one-handed closure capable of being opened and reclosed without need to unscrew from a bottle thread finish, there must be at least two or more parts in the closure construction and they must move relative to other assembly parts during open and reclose actions.

A method of construction of a controlled rate of release headspace pressure vent arrangement with a vent-rate preferably independent of a user may use this relative motion of closure sub-assembly parts during open and reclose by means of at least one controlled rate of release vent aperture of small cross-sectional area in one or more of the relative-movement parts and the likes of at least one "plug" and/or "stopper" feature in other mating and relative-movement parts.

When the one-handed closure is in a "closed" positon, the one or more "plugs" and/or "stoppers" may at least substantially "block" or "strict" flow through the one or more small cross-sectional area controlled rate of release vent apertures, and when the one-handed closure is moved from a "closed" positon into a "controlled vent" position the one or more "plugs" and/or "stoppers" may at least substantially release their "block" or "flow restriction" such that headspace pressure may vent through the one or more small cross-sectional area controlled rate of release vent apertures in a controlled rate of release.

By means of the controlled rate of release vent apertures being of small cross-sectional area, and by means of "plugs" and/or "stoppers" sealingly-closing the controlled rate of release vent apertures when in the "closed" position and at least substantially unsealing the controlled rate of release vent apertures when in the "controlled vent" position, the rate of release is controlled solely by the cross-sectional area of the controlled rate of release vent apertures and the orientation of the "plugs" and/or "stoppers" with respect to the controlled rate of release vent apertures while in the "controlled vent" position, and thereby rate of release of headspace pressure is solely determined by the geometry of the controlled rate of release headspace pressure vent arrangement and is independent of a user.

The preferred means of achieving one or more controlled rate of release vent apertures is by combining plastic and thermosetting rubber features together such that the plastic features may provide the one or more "plug" or "flow" restriction features and the thermosetting rubber may provide the one or more controlled rate off release vent aperture features.

A controlled rate of release headspace pressure vent arrangement may be created by one or more integral parts, such as by means of over-moulding one or more different materials into the closure construction, or by separate and individual parts of the same or alternate materials assembled together to form a controlled rate of release headspace pressure vent arrangement.

For the construction of controlled rate of release headspace pressure vent arrangements, the preferred plastic is polypropylene, the preferred thermoset rubber is TPE or the like, and the preferred means of construction is by means of integrally over-moulding one or more materials.

A one-handed closure capable of being opened and reclosed without need to unscrew from a bottle thread finish may also incorporate one or more headspace over-pressure relief valve mechanisms that may automatically vent headspace pressure if the headspace pressures rises to a pre-set maximum value above atmospheric pressure. The one or more headspace over-pressure relief valve mechanisms may be separate and individual features within a one-handed closure arrangement, or at least one or more of the headspace over-pressure relief valve mechanisms may be an integral part of one or more controlled rate of release headspace pressure vent arrangements.

The preferred one or more headspace over-pressure relief valve mechanisms form part of one or more controlled rate of release headspace pressure vent arrangements.

While a headspace pressure lock arrangement may inhibit a user from readily and freely opening the closure directly from a "closed" into a "drink" position, it may equally not inhibit a user from freely opening the closure from a "closed" into a "controlled vent" position, thereby a user may be able to safely and single-handedly open the closure by a sequence of actions as part of a closed loop control system. By example only, a method of operation of a one-handed closure capable of being opened and reclosed without need to unscrew from a bottle thread finish may include the following steps:

- when the closure is required to be in the sealed position, that is the bottle is during transit, in storage, or a user is not ready to drinking the beverage, the closure is in a "closed" position and thereby the bottle headspace is sealingly closed,
- for below atmospheric pressure closures, in the "closed" position the headspace pressure may be lower than atmospheric pressure and the headspace vacuum in conjunction with the closure sealing system may cause the closure to be sealingly vacuum-locked closed and thereby inhibit a user from opening the closure into the "drink" position but leave the closure free to be moved into a "controlled vent" position,
- for above atmospheric pressure closures, the headspace pressure may be greater than atmospheric pressure and the headspace pressure lock arrangement in conjunction with the closure sealing system may engage and interlock closed the closure thereby inhibiting a user from opening the closure into the "drink" position but leave the closure free to be moved into a "controlled vent" position, when a user is ready to drink from the beverage, they are freely able to move the closure from the "closed" into a "controlled vent" position, at which time the controlled rate of release headspace pressure vent is opened and the headspace pressure is allowed to equalise with atmospheric pressure at a rate pre-set by the size of the vent aperture in the controlled rate of release headspace pressure vent arrangement and thereby at a vent-rate independent of a user, for below atmospheric pressure closures, once in the "controlled vent" position the headspace pressure may at a pre-set controlled rate equalise with atmospheric pressure by means of the at least one or more controlled rate of release headspace pressure vent arrangements and once the headspace pressure is at least substantially close to atmospheric pressure the vacuum in the headspace may have reduced to the point where the vacuum-lock may release sufficiently for a user to fully and freely open the closure into the "drink" position, for above atmospheric pressure closures, once in the "controlled vent" position the headspace pressure may at a pre-set controlled rate equalise with atmospheric pressure by means of the at least one or more controlled rate of release headspace pressure vent arrangements and once headspace pressure is at least substantially close to atmospheric pressure the headspace pressure lock arrangement may disengage sufficiently for a user to fully and freely open the closure into the "drink" position, at least one controlled-rate headspace pressure vent arrangement may incorporate a headspace over-pressure relief valve mechanism.

A one-handed closure capable of being opened and reclosed without need to unscrew from a bottle thread finish may include means of tamper-evidence of any form or means. A typical means of tamper-evidence is in the form of a tamper-evidence ring that fractures free when the closure is unscrewed from the bottle thread finish, thereby leaving evidence of closure removal. As the intent is for the one-handed closure to remain secured to the bottle thread finish at all times, the tamper-evidence in the form of a tamper-evidence ring that may easily fracture-free from the closure may instead be adapted such that the fracture-point becomes a region difficult to fracture such that the closure is inhibited from easy removal from the bottle thread finish.

In a first preferred embodiment, there is provided a closure for above atmospheric headspace pressure beverages that may be opened and reclosed by a user in substantially a one-handed manner; comprising a flip-top lid and drinking aperture plug subassembly that may be opened and reclosed over a substantially wide drinking aperture, at least one headspace pressure lock mechanism, at least one controlled rate of release headspace pressure equalisation valve arrangement, and a sealing system suitable for multiple re-use, and whereby while the headspace pressure is at least substantially above atmospheric pressure the headspace pressure lock mechanism may at least substantially employ the use of the headspace pressure itself to at least substantially ensure that the flip-top lid and drinking aperture plug subassembly cannot freely be opened into a "drink" position by a user, whereby when the flip-top lid and drinking aperture plug subassembly is freely moved into an intermediate "controlled vent" position without interference from the headspace pressure interlock mechanism the headspace pressure equalisation valve arrangement may enable the headspace pressure to be vented downwards towards atmospheric pressure such that it may at least substantially equalise with atmospheric pressure at a pre-set and controlled rate independent of a user thereby allowing safe and controlled venting of the headspace pressure and the minimal generation of effervescence, and whereby once the headspace pressure has at least significantly equalised with atmospheric pressure the headspace pressure interlock system may release its headspace pressure lock sufficiently to enable the one-handed closure to be fully and freely opened and reclosed as required by a user, thereby enabling a user to open the closure into a "drink" position and drink the beverage through the substantially wide drinking aperture. Upon reclosing, any residual pressure in the beverage may lead to a re-build-up in pressure in the headspace such that the headspace pressure lock may once again at least substantially engage and lock-closed the one-handed closure. The one-handed closure may incorporate a headspace over-pressure relief valve mechanism in case headspace pressure rises above a pre-set maximum level. The one-handed closure arrangement may include tamper-evidence. The one-handed closure arrangement may include means of hygiene protection. The one-handed closure may include means to inhibit removal of the closure from the bottle thread finish.

In a second preferred embodiment, there is provided a closure for below atmospheric headspace pressure beverages that may be opened and reclosed by a user in substantially a one-handed manner; comprising a flip-top lid and drinking aperture plug subassembly that may be opened and reclosed over a substantially wide drinking aperture, at least one controlled rate of release headspace pressure equalisation valve arrangement, and a headspace sealing system suitable for multiple re-use, and whereby while the headspace pressure is at least substantially below atmospheric pressure the headspace sealing system may enable a vacuum to form in the headspace of sufficient strength to at least substantially "vacuum-lock" the flip-top lid and drinking aperture plug subassembly closed onto the closure such that it cannot freely be opened into a "drink" position by a user, whereby when the flip-top lid and drinking aperture plug subassembly is freely moved into an intermediate "controlled vent" position without interference from the headspace "vacuum-lock" the headspace pressure equalisation valve arrangement may enable the headspace pressure to be vented upwards towards atmospheric pressure such that it may at least substantially equalise with atmospheric pressure at a pre-set and controlled rate independent of a user thereby allowing safe and controlled venting of the headspace pressure, and whereby once the headspace pressure has at least significantly equalised with atmospheric pressure the headspace "vacuum-lock" may release its headspace lock sufficiently to enable the one-handed closure to be fully and freely opened and reclosed as required by a user, thereby enabling a user to open the closure into a "drink" position and drink the beverage through the substantially wide drinking aperture. The one-handed closure arrangement may include tamper-evidence. The one-handed closure arrangement may include means of hygiene protection. The one-handed closure may include means to inhibit removal of the closure from the bottle thread finish.

In a third preferred embodiment, there is provided a closure for headspace pressure beverages that may be opened and reclosed by a user in substantially a one-handed manner; comprising a tap, valve or spout that may be opened and reclosed incorporating a substantially narrow drinking aperture, at least one headspace pressure lock mechanism, at least one controlled rate of release headspace pressure equalisation valve arrangement, and a sealing system suitable for multiple re-use, and whereby while the headspace pressure is at least substantially above or below atmospheric pressure the headspace pressure lock mechanism may at least substantially employ the use of the headspace pressure itself to at least substantially ensure that the tap, valve or spout cannot freely be opened into a "drink" position by a user, whereby when at least a component part of the tap, valve or spout arrangement is freely moved into an intermediate "controlled vent" position without interference from the headspace pressure interlock mechanism the headspace pressure equalisation valve arrangement may enable the headspace pressure to be vented towards atmospheric pressure such that it may at least substantially equalise with atmospheric pressure at a pre-set and controlled rate independent of a user thereby allowing safe and controlled venting of the headspace pressure and for above atmospheric applications, the minimal generation of effervescence, and whereby once the headspace pressure has at least significantly equalised with atmospheric pressure the headspace pressure interlock system may release its headspace pressure lock sufficiently to enable the one-handed closure to be fully and freely opened and reclosed as required by a user, thereby enabling a user to open the closure into a "drink" position and drink the beverage through the substantially narrow drinking aperture. For above atmospheric applications, upon reclosing, any residual pressure in the beverage may lead to a re-build-up in pressure in the headspace such that the headspace pressure lock may once again at least substantially engage and lock-closed the one-handed closure. For above atmospheric applications, the one-handed closure may incorporate a headspace over-pressure relief valve mechanism in case headspace pressure rises above a pre-set maximum level. The one-handed closure arrangement may include tamper-evidence. The one-handed closure arrangement may include means of hygiene protection. The one-handed closure may include means to inhibit removal of the closure from the bottle thread finish.

Further aspects of the invention, which should be considered in all its novel aspects, will become apparent from the following description, which is given by way of example only.

BRIEF DESCRIPTION OF DRAWINGS

Examples of the invention will become apparent from the following description which is given by way of example with reference to the accompanying drawings which.

DETAILED DESCRIPTION

Figure 1:
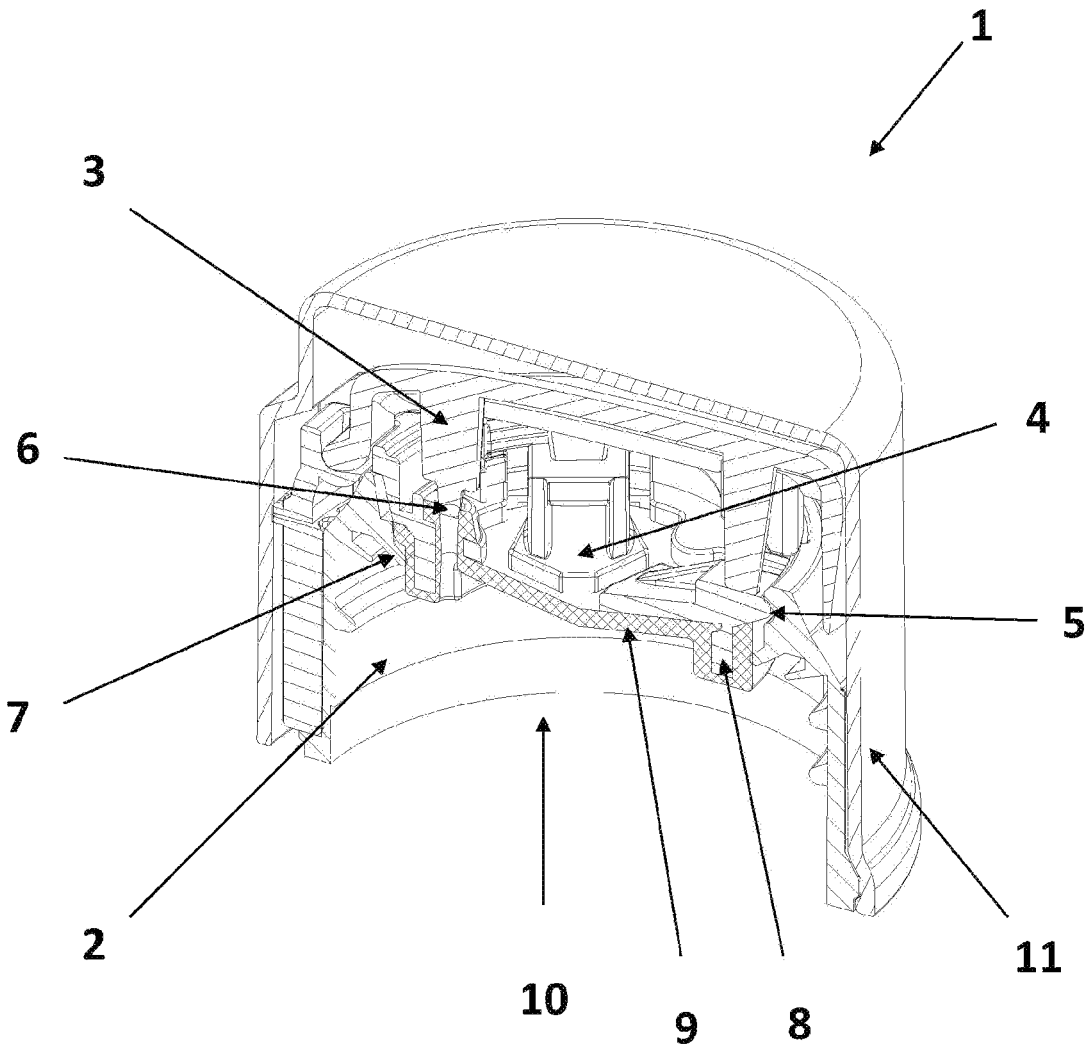
FIG. 1 shows a three-dimensional cross section of an above atmospheric pressure one-handed closure with substantially wide drinking aperture and flip-top plug in a "sealed closed" position according a first preferred embodiment of the present invention.

It will be appreciated that terminology such as "upwards", "downwards", "above" and "below" etc. as used in this specification refer to the orientations shown in the drawings and orientations obvious to those versed in the art. The terms are used to indicate relative orientations, but should not be considered to be otherwise limiting.

Referring to FIG. 1, a closure for above atmospheric headspace pressure beverages with a substantially wide drinking aperture that may be opened and reclosed by a user in substantially a one-handed manner 1 is depicted in three-dimensional cross-section view in a "sealed closed" position including a main closure body 2 which includes the thread finish and means of pressure sealing when engaged onto a bottle thread finish (bottle thread finish not depicted), a flip-top lid 3 and a drinking aperture plug subassembly 4 that may be opened and reclosed over a substantially wide drinking aperture, at least one headspace pressure lock mechanism 5 (as depicted, incorporated into the flip-top lid 3 and drinking aperture plug subassembly 4), at least one controlled rate of release headspace pressure equalisation valve arrangement 6 (as depicted, incorporated into the flip-top lid 3 and drinking aperture plug subassembly 4, and depicted in a "sealed closed" position), and a sealing system suitable for multiple re-use 7.

The drinking aperture plug subassembly 4 may comprise one or more alternate materials either assembled as separate parts and/or over-moulded into an integral structure. As depicted, the drinking aperture plug subassembly 4 is an integral structure comprising at least one thermoplastic polymer part 8, typically polypropylene, and at least one thermoplastic elastomer part 9, typically TPE or the like.

While the headspace pressure is at least substantially above atmospheric pressure the headspace pressure lock mechanism 5 may at least substantially employ the use of the headspace pressure 10 itself to at least substantially ensure that the drinking aperture plug subassembly 4 cannot freely be opened into a "drink" position by a user. As depicted, this is achieved by means of the above atmospheric pressure headspace pressure 10 applying pressure upwards onto the drinking aperture plug subassembly 4 such that the combination of the least one thermoplastic polymer part 8 and/or the at least one thermoplastic elastomer part 9 flex in such a way as to lockingly engage the at least one headspace pressure lock mechanism 5 into a "locked" or "interlocked" mode.

While in this "sealed closed" position, the one-handed closure arrangement 1 is constrained from freely being opened into a "drink" position by a user.

The one-handed closure arrangement 1 may include mean of tamper-evidence (not depicted). The one-handed closure arrangement 1 may include means of hygiene protection 11 (as depicted, in the form of a removable cover). The one-handed closure arrangement 1 may include means to inhibit removal of the closure from the bottle thread finish (not depicted).

Figure 2:
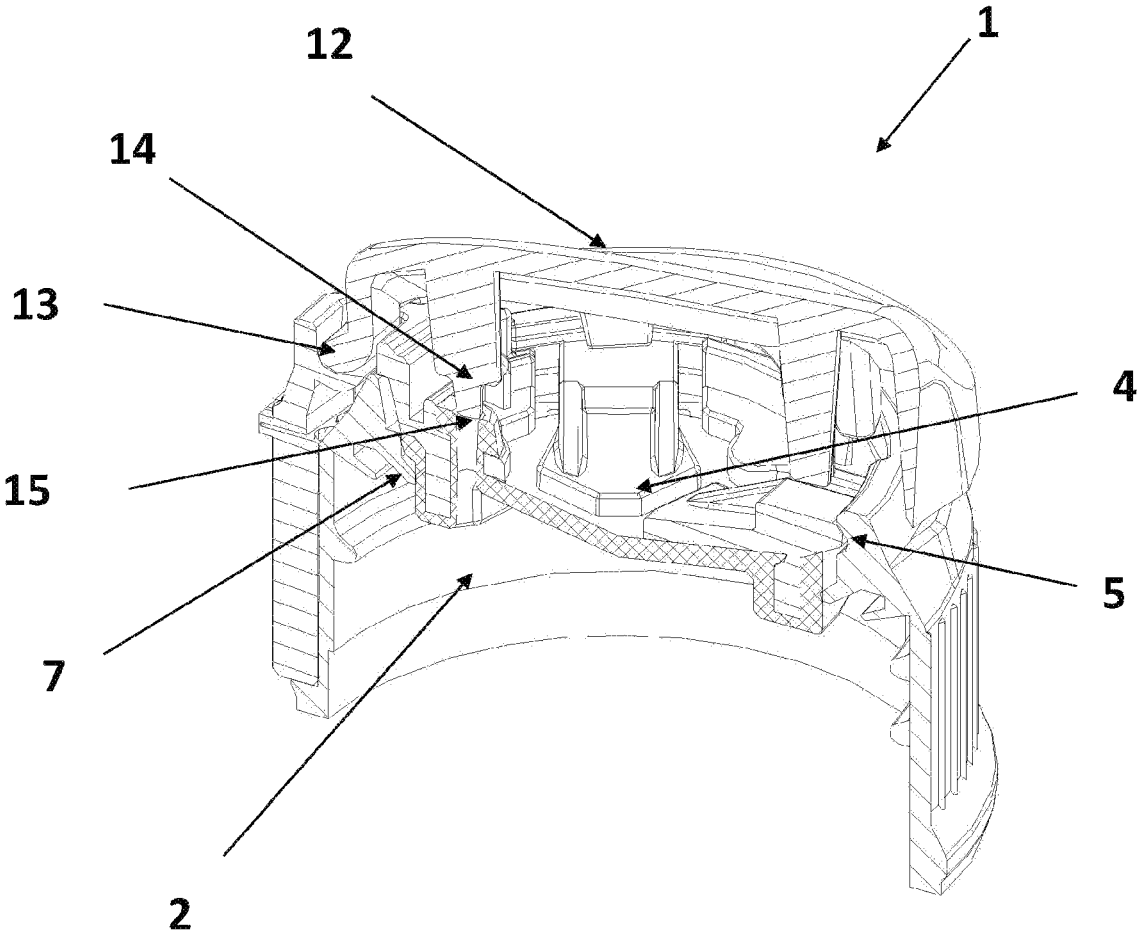
FIG. 2 shows a three-dimensional cross section view of the above atmospheric pressure one-handed closure with substantially wide drinking aperture and flip-top plug of FIG. 1 with the flip-top plug in a "controlled vent" position.

Referring to FIG. 2, the closure for above atmospheric headspace pressure beverages with a substantially wide drinking aperture that may be opened and reclosed by a user in substantially a one-handed manner 1 of FIG. 1 is depicted in three-dimensional cross-section view in a "controlled vent" position.

Once any means of hygiene protection 11 of FIG. 1 has been removed, the flip-top lid 3 of FIG. 1 is freely able to be moved by a user rotatably upwards into a controlled vent position 12, whilst at the same time the drinking aperture plug subassembly 4 remains seatingly and sealingly engaged down onto the main closure body 2, and the at least one headspace pressure lock mechanism 5 and the sealing system suitable for multiple re-use 7 both remain engaged.

The flip-top lid 3 of FIG. 1 is able to be rotatably moved into a controlled vent position 12 by means of a rotatable hinge 13 between the flip-top lid 3 of FIG. 1 and the drinking aperture plug subassembly 4. There may be rotation limiting means to restrict the degree of rotatable movement (not depicted).

Once the flip-top lid 3 of FIG. 1 has been rotatably moved into a controlled vent position 12, the at least one controlled rate of release headspace pressure equalisation valve arrangement 6 of FIG. 1 is caused to transition from a "sealed closed" to a "controlled vent" position by means of the relative movement of the at least one pressure equalisation valve plug 14 (as depicted, as part of the flip-top lid 3) and the at least one pressure equalisation valve aperture 15 (as depicted, as part of the drinking aperture plug subassembly 4). The at least one pressure equalisation valve plug 14 may be a thermoplastic polymer such as polypropylene and the at least one pressure equalisation valve aperture 15 may be a thermoplastic elastomer such as TPE or the like.

The one-handed closure arrangement 1 may incorporate a headspace over-pressure relief valve mechanism in case headspace pressure rises above a pre-set maximum level. As depicted, the at least one pressure equalisation valve aperture 15 formed of thermoplastic elastomer may flex outwards at a pre-determined maximum headspace pressure and thereby free itself of the sealingly plugged constraints of the at least one pressure equalisation valve plug 14, and thereby form an over-pressure relief valve.

The relative movement of the at least one controlled rate of release headspace pressure equalisation valve arrangement 6 of FIG. 1 with respect to each other may create a small vent aperture and may enable the headspace pressure to be vented downwards towards atmospheric pressure such that it may at least substantially equalise with atmospheric pressure at a pre-set and controlled rate dependent on the vent aperture size so formed and independent of a user thereby allowing safe and controlled venting of the headspace pressure and minimal generation of effervescence.

Figure 3:
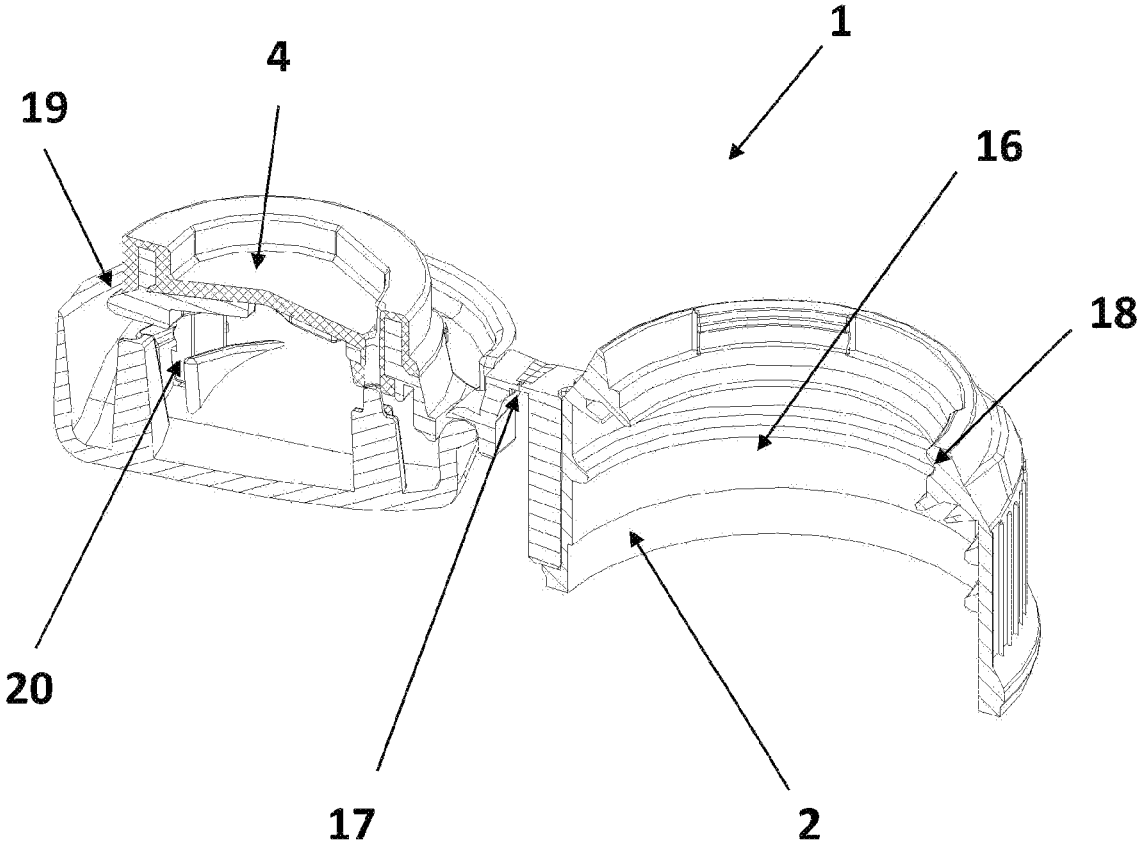
FIG. 3 shows a three-dimensional cross section view of the above atmospheric pressure one-handed closure with substantially wide drinking aperture and flip-top plug of FIGS. 1 and 2 with the flip-top plug in a fully open "drink" position.

Referring to FIG. 3, the closure for above atmospheric headspace pressure beverages with a substantially wide drinking aperture that may be opened and reclosed by a user in substantially a one-handed manner 1 of Figures One and Two is depicted in three-dimensional cross-section view in a fully open "drink" position.

Once the headspace pressure has at least significantly equalised with atmospheric pressure, the at least one headspace pressure interlock system 5 of Figures One and Two may release its headspace pressure lock sufficiently to enable the one-handed closure to be fully and freely opened and reclosed as required by a user, thereby enabling a user to freely open the closure into a "drink" position and drink the beverage through the substantially wide drinking aperture 16. The opening into a "drink" position may be by means of a living hinge arrangement 17, either integral to or a separate part of the drinking aperture plug subassembly 4. The living hinge arrangement 17 may include means of hinge bias to ensure the "drink" position remains as open as possible.

In the "drink" position as depicted in three-dimensional cross-section view, the at least one headspace pressure interlock system 5 of Figures One and Two can be seen to comprise at least one or more undercut recesses 18 as part of the main closure body 2 that lockingly engage with at least one or more locking features 19 as part of the drinking aperture plug subassembly 4. Means of rotation limiting 20 to restrict the degree of rotatable movement of the flip-top lid 3 of FIG. 1 can also be seen in this view.

Upon reclosing, any residual pressure in the beverage may lead to a re-build-up in pressure in the headspace such that the headspace pressure lock arrangement 5 of Figures One and Two may once again at least substantially engage and lock-closed the one-handed closure.

A closure for above atmospheric headspace pressure beverages with a substantially wide drinking aperture that may be opened and reclosed by a user in substantially a one-handed manner has thereby been formed that will allow a user to "chug" their beverage while drinking.

Figure 4:
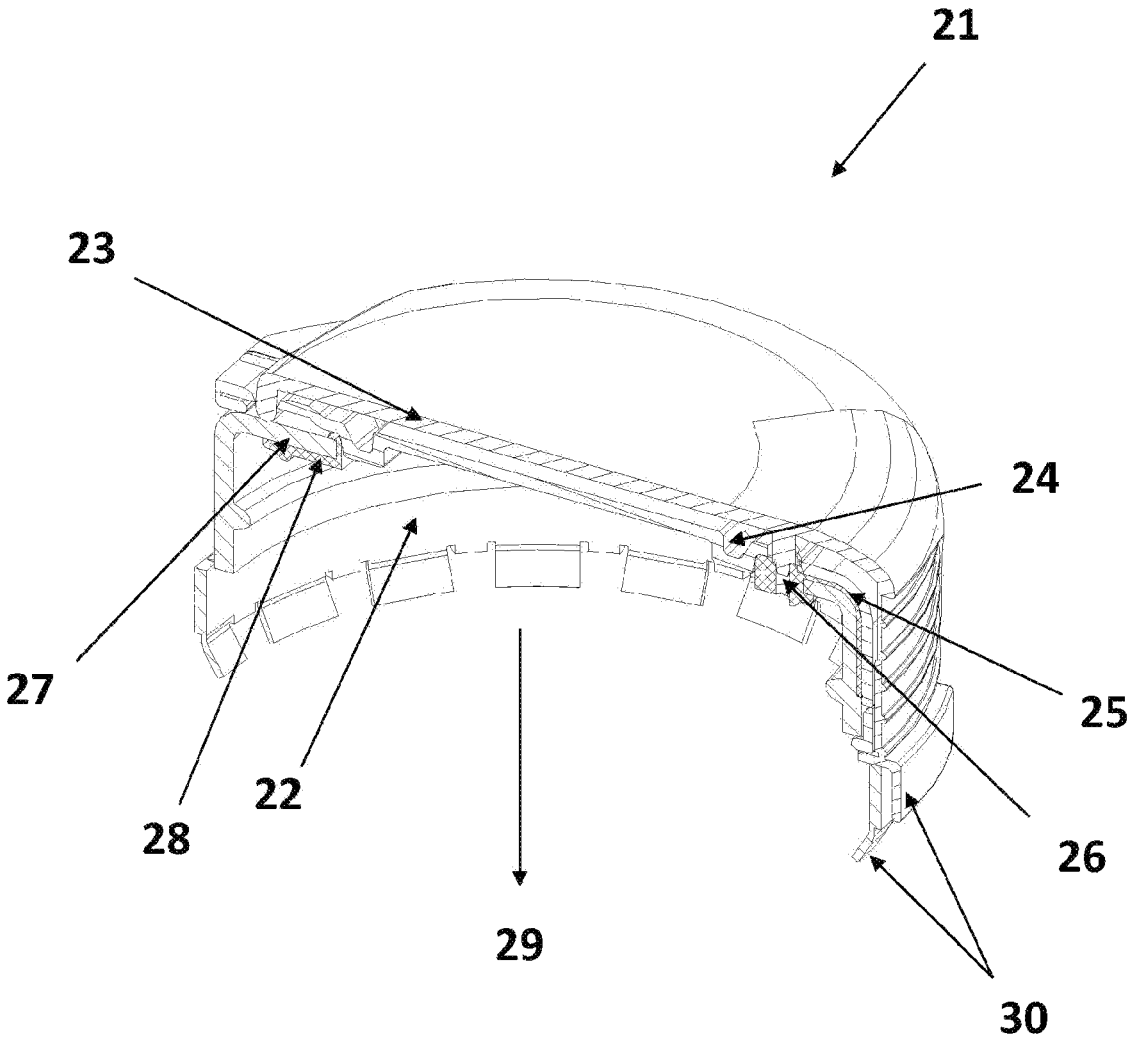
FIG. 4 shows a three-dimensional cross section view of a below atmospheric pressure one-handed closure with substantially wide drinking aperture and flip-top plug in a "sealed closed" position according a second preferred embodiment of the present invention.

Referring to FIG. 4, a closure for below atmospheric headspace pressure beverages with a substantially wide drinking aperture that may be opened and reclosed by a user in substantially a one-handed manner 21 is depicted in three-dimensional cross-section view in a "sealed closed" position including a main closure body arrangement 22 which includes the thread finish and means of pressure sealing when engaged onto a bottle thread finish (bottle thread finish not depicted), a flip-top lid 23 and a drinking aperture plug 24 that may be opened and reclosed over a substantially wide drinking aperture, at least one headspace pressure lock mechanism 25 (as depicted, comprising the main closure body arrangement 22 and drinking aperture plug 24), at least one controlled rate of release headspace pressure equalisation valve arrangement 26 (as depicted, comprising the flip-top lid 23 and main closure body arrangement 22, and depicted in a "sealed closed" position), and a sealing system suitable for multiple re-use (as depicted, being the same headspace pressure lock mechanism 25).

The main closure body arrangement 22 may comprise one or more alternate materials either assembled as separate parts and/or over-moulded into an integral structure. As depicted, the main closure body arrangement 22 is an integral structure comprising at least one thermoplastic polymer part 27, typically polypropylene, and at least one thermoplastic elastomer part 28, typically a TPE or the like.

While the headspace pressure 29 is at least substantially below atmospheric pressure the headspace pressure lock mechanism 25 may at least substantially employ the use of the headspace pressure itself to at least substantially ensure that the drinking aperture plug 24 cannot freely be opened into a "drink" position by a user. As depicted, this is achieved by means of the below atmospheric pressure headspace pressure 29 applying pressure downwards onto the drinking aperture plug 24 such that the drinking aperture plug 24 is sealingly engaged down onto the least one thermoplastic elastomer part 28 by means of the resulting vacuum thereby formed in the headspace in such a way as to lockingly and sealingly engage closed the one-handed closure arrangement 21.

While in this "sealed closed" position, the one-handed closure arrangement 21 is constrained from freely being opened into a "drink" position by a user.

The one-handed closure arrangement 21 may include mean of tamper-evidence 30. The one-handed closure arrangement 21 may include means of hygiene protection (not depicted). The one-handed closure arrangement 21 may include means to inhibit removal of the closure from the bottle thread finish (not depicted).

Figure 5:
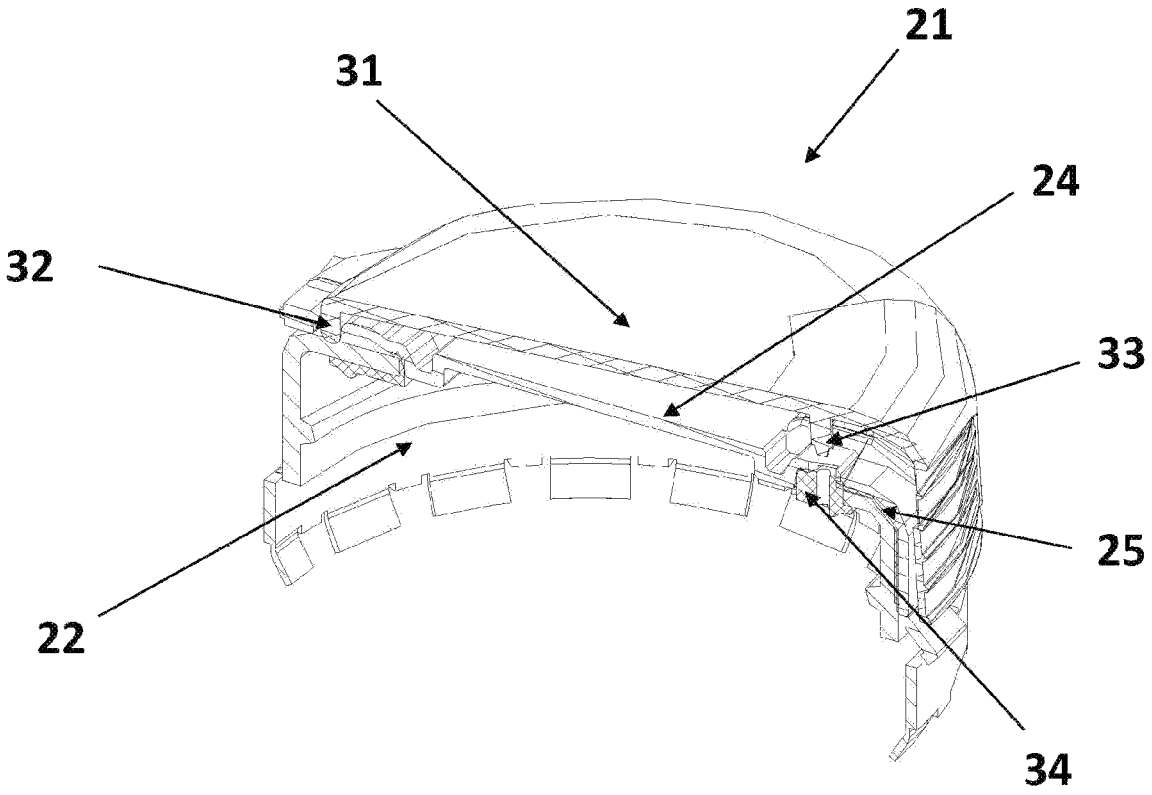
FIG. 5 shows a three-dimensional cross section view of the below atmospheric pressure one-handed closure with substantially wide drinking aperture and flip-top plug of FIG. 4 with the flip-top plug in a "controlled vent" position.

Referring to FIG. 5, the closure for below atmospheric headspace pressure beverages with a substantially wide drinking aperture that may be opened and reclosed by a user in substantially a one-handed manner 21 of FIG. 4 is depicted in three-dimensional cross-section view in a "controlled vent" position.

Once any means of hygiene protection has been removed, and the tearing off of any one or more tamper evidence features 30 of FIG. 4, the flip-top lid 23 of FIG. 4 is freely able to be moved by a user rotatably upwards into a controlled vent position 31, whilst at the same time the drinking aperture plug 24 remains seatingly and sealingly engaged down onto the main closure body arrangement 22, and the at least one headspace pressure lock mechanism incorporating the sealing system suitable for multiple re-use 25 remains engaged.

The flip-top lid 23 of FIG. 4 is able to be rotatably moved into a controlled vent position 31 by means of a rotatable hinge 32 between the flip-top lid 23 of FIG. 4 and the drinking aperture plug 24. There may be rotation limiting means to restrict the degree of rotatable movement (not depicted).

Once the flip-top lid 23 of FIG. 4 has been rotatably moved into a controlled vent position 31, the at least one controlled rate of release headspace pressure equalisation valve arrangement 26 of FIG. 4 is caused to transition from a "sealed closed" to a "controlled vent" position by means of the relative movement of the at least one pressure equalisation valve plug 33 (as depicted, as part of the flip-top lid 31) and the at least one pressure equalisation valve aperture 34 (as depicted, as part of the main closure body arrangement 22). The at least one pressure equalisation valve plug 33 may be a thermoplastic polymer such as polypropylene and the at least one pressure equalisation valve aperture 34 may be a thermoplastic elastomer such as TPE or the like.

The relative movement of the at least one controlled rate of release headspace pressure equalisation valve arrangement 26 of FIG. 4 with respect to each other may create a small vent aperture and may enable the headspace pressure to be vented upwards towards atmospheric pressure such that it may at least substantially equalise with atmospheric pressure at a pre-set and controlled rate dependent on the vent aperture size so formed and independent of a user thereby allowing safe and controlled venting of the headspace pressure.

Figure 6:
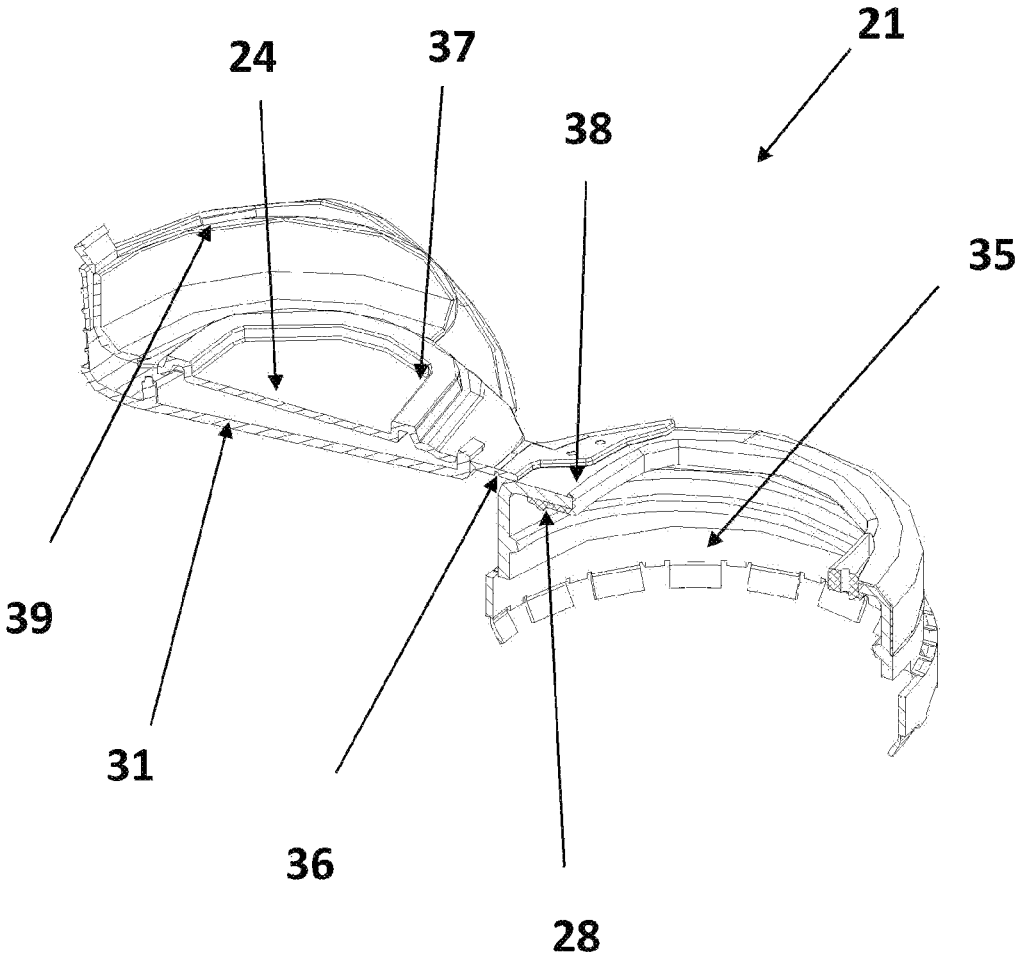
FIG. 6 shows a three-dimensional cross section view of the below atmospheric pressure one-handed closure with substantially wide drinking aperture and flip-top plug of FIGS. 4 and 5 with the flip-top plug in a fully open "drink" position.

Referring to FIG. 6, the closure for below atmospheric headspace pressure beverages with a substantially wide drinking aperture that may be opened and reclosed by a user in substantially a one-handed manner 21 of Figures Four and Five is depicted in three-dimensional cross-section view in a fully open "drink" position.

Once the headspace pressure has at least significantly equalised with atmospheric pressure the at least one headspace pressure interlock system 25 of Figures Four and Five may release its headspace pressure lock sufficiently to enable the one-handed closure to be fully and freely opened and reclosed as required by a user, thereby enabling a user to freely open the closure into a "drink" position and drink the beverage through the substantially wide drinking aperture 35. The opening into a "drink" position may be by means of a living hinge arrangement 36, either integral to or a separate part of the drinking aperture plug 24. The living hinge arrangement 36 may include means of hinge bias to ensure the "drink" position remains as open as possible.

In the "drink" position as depicted in three-dimensional cross-section view, the at least one headspace pressure interlock system 25 of FIG. 4 can be seen to comprise substantially flat surfaces 37 on the thermoplastic polymer drinking aperture plug 24 and raised surfaces 38 on the least one thermoplastic elastomer part 28, that when engaged together and a vacuum forms in the headspace, the two thereby sealingly engage. Means of rotation limiting 39 to restrict the degree of rotatable movement of the flip-top lid 31 can also be seen in this view.

A closure for below atmospheric headspace pressure beverages with a substantially wide drinking aperture that may be opened and reclosed by a user in substantially a one-handed manner has thereby been formed that will allow a user to "chug" their beverage while drinking.

Figure 7:
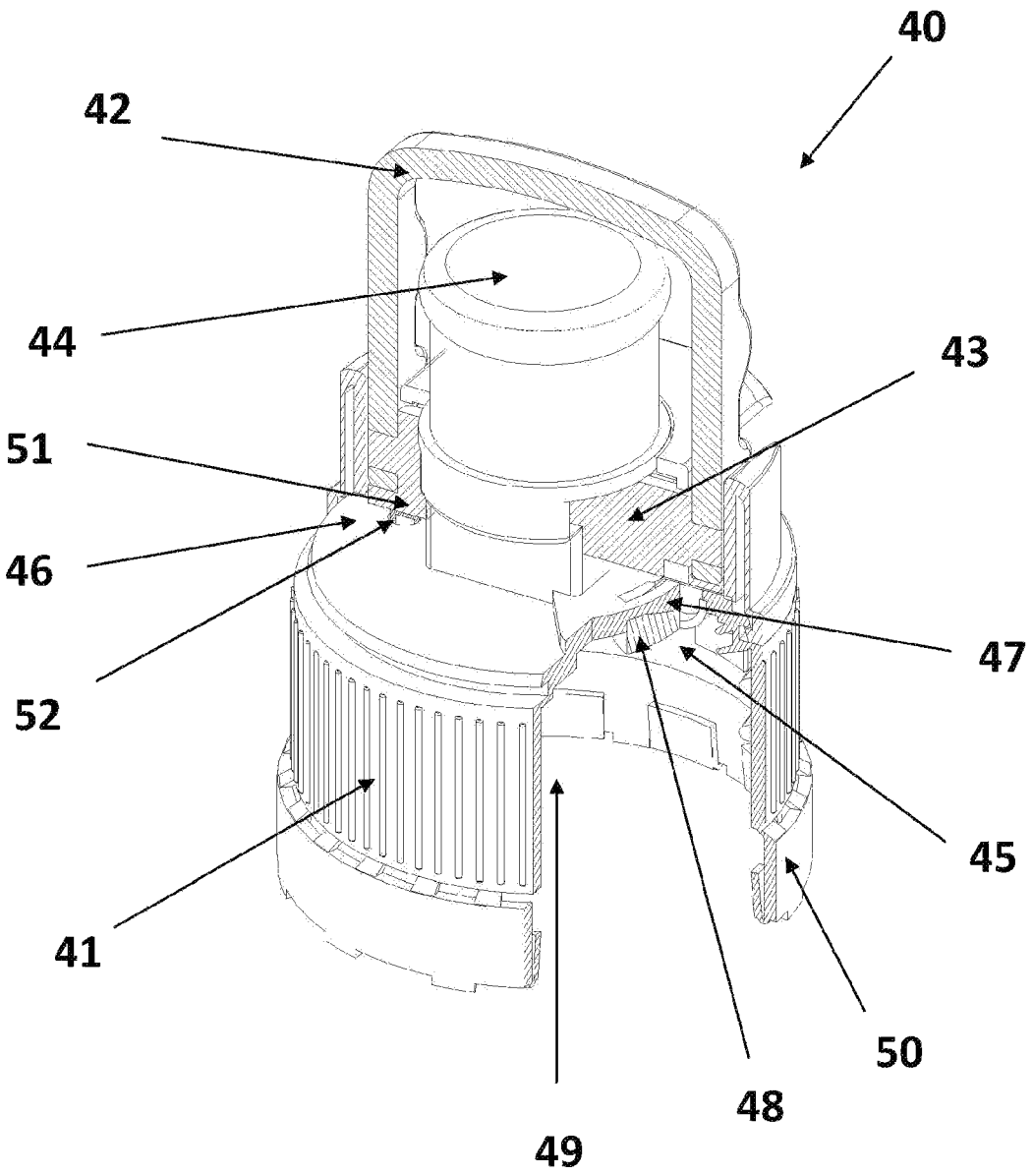
FIG. 7 shows a three-dimensional cross section view of a one-handed closure with substantially narrow drinking aperture and lever-action means of opening in a "sealed closed" position according to a third preferred embodiment of the present invention.

Referring to FIG. 7, a closure for pressurised headspace beverages with a substantially narrow drinking aperture that may be opened and reclosed by a user in substantially a one-handed manner 40 is depicted in three-dimensional cross-section view in a "sealed closed" position including a main closure body arrangement 41 which includes the thread finish and means of pressure sealing when engaged onto a bottle thread finish (bottle thread finish not depicted), a lever-action means of opening and reclosing 42, a drinking aperture sealing plug 43 that may rotatingly open and reclose a substantially narrow drinking aperture 44, at least one headspace pressure lock arrangement 45, at least one controlled rate of release headspace pressure equalisation valve arrangement 46, and a sealing system suitable for multiple re-use (not depicted).

The assembly may comprise one or more alternate materials either assembled as separate parts and/or over-moulded into an integral structure. As depicted, the main closure body arrangement 41 is an integral structure comprising at least one thermoplastic polymer part 47, typically polypropylene, and at least one thermoplastic elastomer part 48, typically a TPE or the like.

While the headspace is pressurised, the at least one headspace pressure lock arrangement 45 may at least substantially employ the use of the headspace pressure 49 itself to at least substantially ensure that the drinking aperture sealing plug 43 cannot freely be rotated into a "drink" position by a user. As depicted, this is achieved by means of the headspace pressure 49 applying pressure onto the at least one headspace pressure lock arrangement 45 such that the combination of the least one thermoplastic polymer part 47 and/or the at least one thermoplastic elastomer part 48 flex in such a way as to lockingly or jammingly restrict the drinking aperture sealing plug 43 from being freely rotated into a "drink" position.

It will be apparent to those versed in the art that by means of changes in the geometry, shape, form or design of the at least one headspace pressure lock arrangement 45, the at least one headspace pressure lock arrangement 45 may readily be optimized to function as a locking or jamming means for either above atmospheric headspace pressure and/or below atmospheric headspace pressure beverages.

While in this "sealed closed" position, the one-handed closure arrangement 40 is constrained from freely being opened into a "drink" position by a user.

The one-handed closure arrangement 40 may include mean of tamper-evidence 50. The one-handed closure arrangement 40 may include means of hygiene protection (not depicted). The one-handed closure arrangement 40 may include means to inhibit removal of the closure from the bottle thread finish (not depicted).

Once any means of hygiene protection has been removed, the lever-action means of opening and reclosing 42 may freely and rotatably be moved by a user sufficiently to in-turn rotate the drinking aperture sealing plug 43 from a "sealed closed" into a "controlled vent" position (not depicted), however during this rotation into the "controlled vent" position the at least one headspace pressure lock arrangement 45 remains engaged, and thereby a user cannot freely further rotate the one-handed closure arrangement 40 into a "drink" position due to the locking or jamming means of the at least one headspace pressure lock arrangement 45 remaining engaged.

Once the lever-action means of opening and reclosing 42 and thereby the drinking aperture sealing plug 43 have freely and rotatably been moved into a controlled vent position, the at least one controlled rate of release headspace pressure equalisation valve arrangement 46 is caused to transition from a "sealed closed" to a "controlled vent" position by means of the relative movement of the rotation action. The at least one controlled rate of release headspace pressure equalisation valve arrangement 46 may comprise thermoplastic polymer features 51 such as the likes of polypropylene as part of the drinking aperture sealing plug 43, and thermoplastic elastomer features 52 such as the likes of TPE as part of the main closure body arrangement 41.

The relative movement of the at least one controlled rate of release headspace pressure equalisation valve arrangement 46 sub-parts with respect to each other may create a small vent aperture and may enable the headspace pressure to be vented towards atmospheric pressure such that it may at least substantially equalise with atmospheric pressure at a pre-set and controlled rate dependent on the vent aperture size so formed and independent of a user thereby allowing safe and controlled venting of the headspace pressure, and for above atmospheric pressure applications, minimal generation of effervescence.

Figure 8:
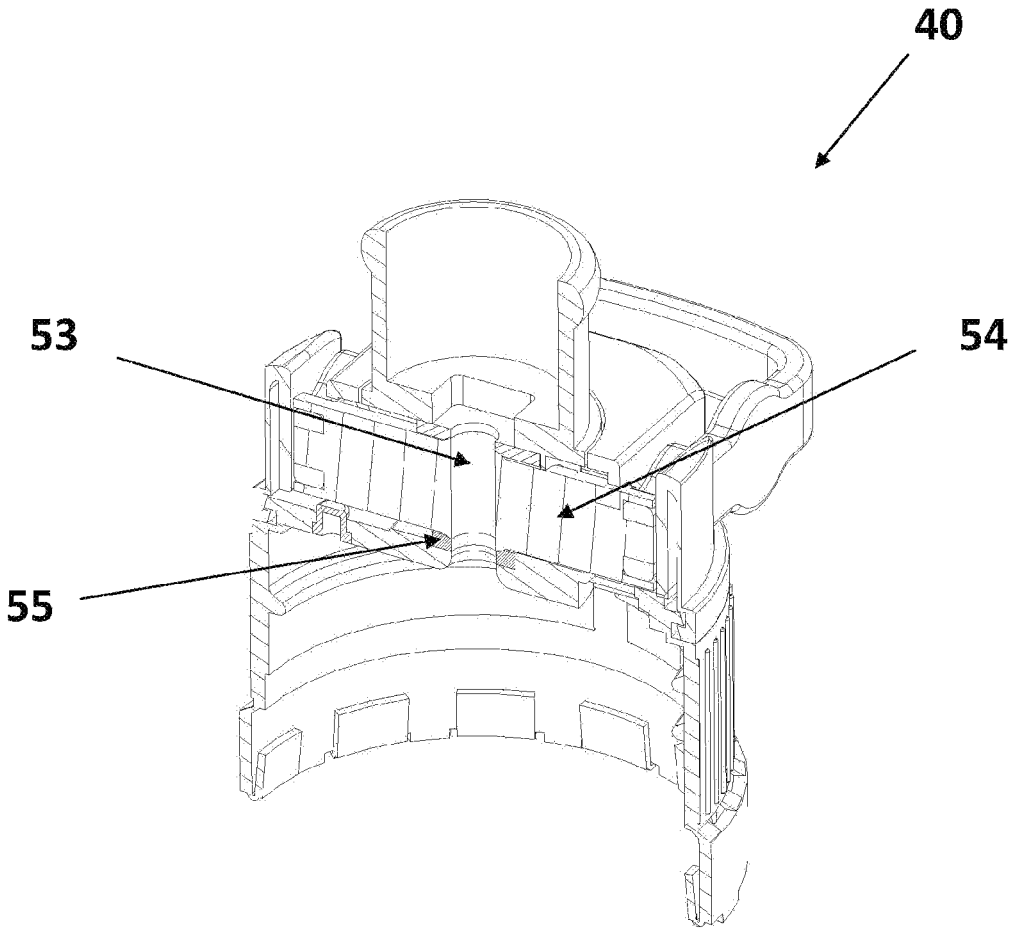
FIG. 8 shows a three-dimensional cross section view of the one-handed closure with substantially narrow drinking aperture and lever-action means of opening of FIG. 7 in a fully open "drink" position.

Referring to FIG. 8, the closure for pressurised headspace beverages with a substantially narrow drinking aperture that may be opened and reclosed by a user in substantially a one-handed manner 40 of FIG. 7 is depicted in three-dimensional cross-section view in a fully open "drink" position.

Once the headspace pressure has at least substantially equalised with atmospheric pressure the at least one headspace pressure lock arrangement 45 of FIG. 7 may release its headspace pressure lock sufficiently to enable the one-handed closure to be fully and freely opened and reclosed as required by a user, thereby enabling a user to freely open the closure into a "drink" position and drink the beverage through the substantially narrow drinking aperture 53. The opening into a "drink" position may be by means of the headspace pressure lock arrangement 45 of FIG. 7 releasing its jamming or locking such that the drinking aperture sealing plug 43 of FIG. 7 is on longer constrained from being rotated into the "drink" position 54.

For above atmospheric pressure applications, upon reclosing, any residual pressure in the beverage may lead to a re-build-up in pressure in the headspace such that the headspace pressure lock arrangement 45 of FIG. 7 may once again at least substantially engage and lock-closed the one-handed closure.

Additional means of sealing 55 may ensure that the closure for pressurised headspace beverages with a substantially narrow drinking aperture that may be opened and reclosed by a user in substantially a one-handed manner 40 is suitable for multiple reuse.

A closure for pressurised headspace beverages with a substantially narrow drinking aperture that may be opened and reclosed by a user in substantially a one-handed manner has thereby been formed.

Figure 9:
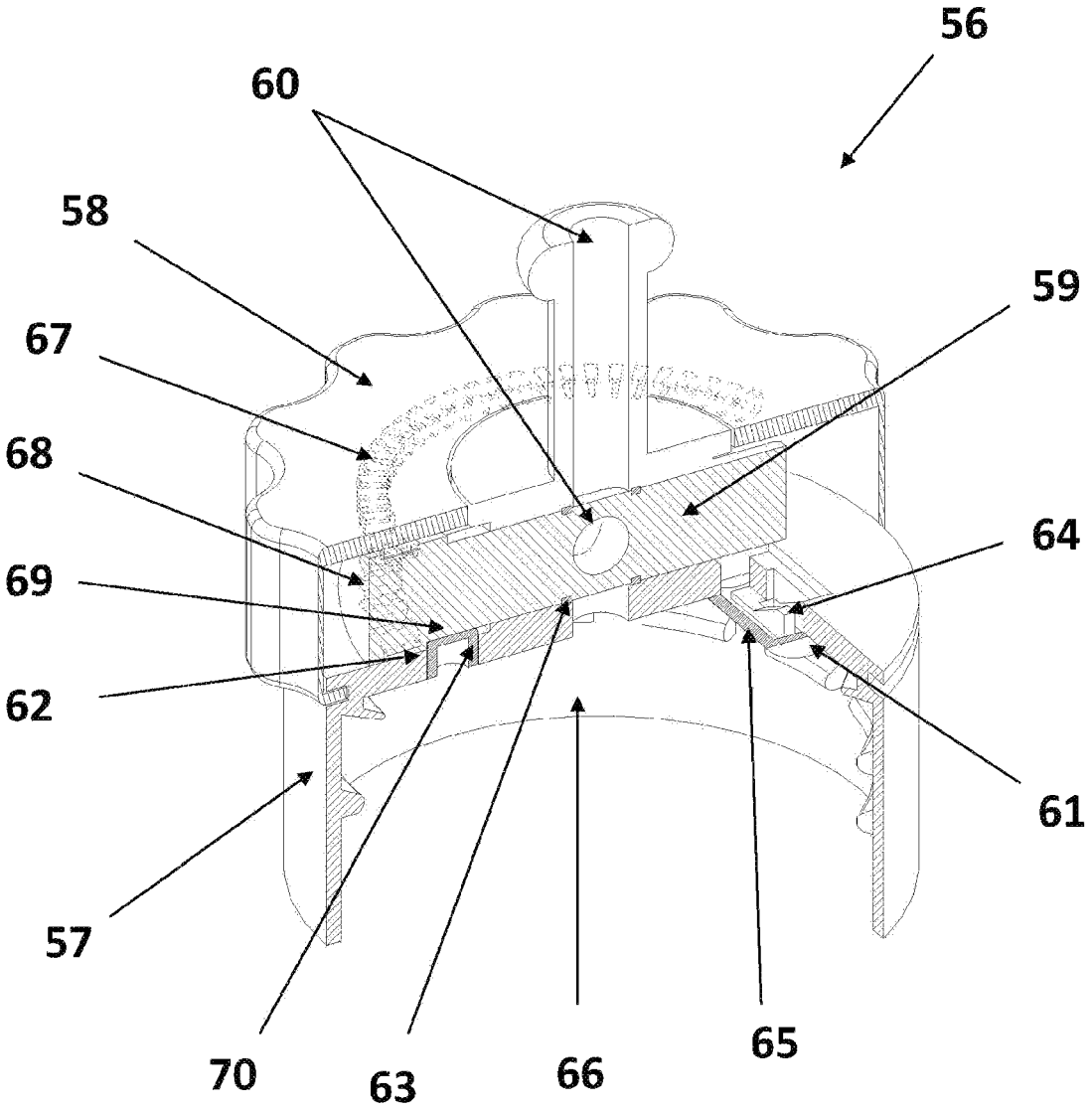
FIG. 9 shows a three-dimensional cross section view of a one-handed closure with substantially narrow drinking aperture and rotatable means of opening in a "sealed closed" position incorporating a gear and pinion arrangement according to the same third preferred embodiment of the present invention.

Referring to FIG. 9, a closure for pressurised headspace beverages with a substantially narrow drinking aperture that may be opened and reclosed by a user in substantially a one-handed manner 56 is depicted in three-dimensional cross-section view in a "sealed closed" position including a main closure body arrangement 57 which includes the thread finish and means of pressure sealing when engaged onto a bottle thread finish (bottle thread finish not depicted), a rotatable means of opening and reclosing incorporating a rack and pinion driving mechanism arrangement 58, a drinking aperture sealing plug 59 that may rotatingly open and reclose a substantially narrow drinking aperture 60, at least one headspace pressure lock arrangement 61, at least one controlled rate of release headspace pressure equalisation valve arrangement 62, and a sealing system suitable for multiple re-use 63.

The assembly may comprise one or more alternate materials either assembled as separate parts and/or over-moulded into an integral structure. As depicted, the main closure body arrangement 57 is an integral structure comprising at least one thermoplastic polymer part 64, typically polypropylene, and at least one thermoplastic elastomer part 65, typically a TPE.

While the headspace is pressurised, the at least one headspace pressure lock arrangement 61 may at least substantially employ the use of the headspace pressure 66 itself to at least substantially ensure that the drinking aperture sealing plug 59 cannot freely be rotated into a "drink" position by a user. As depicted, this is achieved by means of the headspace pressure 66 applying pressure onto the at least one headspace pressure lock arrangement 61 such that the combination of the least one thermoplastic polymer part 64 and/or the at least one thermoplastic elastomer part 65 flex in such a way as to lockingly or jammingly restrict the drinking aperture sealing plug 59 from freely being rotated into a "drink" position.

It will be apparent to those versed in the art that by means of changes in the geometry, shape, form or design of the at least one headspace pressure lock arrangement 61, the at least one headspace pressure lock arrangement 61 may readily be optimized to function as a locking or jamming means for either above atmospheric headspace pressure and/or below atmospheric headspace pressure beverages.

While in this "sealed closed" position, the one-handed closure arrangement 56 is constrained from freely being opened into a "drink" position by a user.

The one-handed closure arrangement 56 may include mean of tamper-evidence (not depicted). The one-handed closure arrangement 56 may include means of hygiene protection (not depicted). The one-handed closure arrangement 56 may include means to inhibit removal of the closure from the bottle thread finish (not depicted).

Once any means of hygiene protection has been removed, the rotatable means of opening and reclosing comprising a rack and pinion driving mechanism arrangement 58 may freely and rotatably be moved by a user sufficiently to in-turn rotate the drinking aperture sealing plug 59 from a "sealed closed" into a "controlled vent" position (not depicted), however during this rotation into the "controlled vent" position the at least one headspace pressure lock arrangement 61 remains engaged, and thereby a user cannot freely further rotate the one-handed closure arrangement 56 into a "drink" positon due to the locking or jamming means of the at least one headspace pressure lock arrangement 61 remaining engaged.

The mechanical drive means of the substantially narrow drinking aperture 60 may be by means of a rotatable rack and pinion driving mechanism arrangement 58 (as depicted, with rack teeth 67 being an integral part of the rotatable rack and pinion driving mechanism arrangement 58 and pinion teeth 68 being an integral part of the drinking aperture sealing plug 59). By means of the gearing engagement of the rack and pinion teeth, when a user rotates the rack and pinion driving mechanism arrangement 58 they in-turn directly effect rotation of the drinking aperture sealing plug 59.

Once the rotatable means of opening and reclosing incorporating a rack and pinion driving mechanism arrangement 58 and thereby the drinking aperture sealing plug 59 have freely and rotatably been moved into a controlled vent position, the at least one controlled rate of release headspace pressure equalisation valve arrangement 62 is caused to transition from a "sealed closed" to a "controlled vent" position by means of the relative movement of the rotation action. The at least one controlled rate of release headspace pressure equalisation valve arrangement 62 may comprise thermoplastic polymer features 69 such as the likes of polypropylene as part of the drinking aperture sealing plug 59, and thermoplastic elastomer features 70 such as the likes of TPE as part of the main closure body arrangement 57.

The relative movement of the at least one controlled rate of release headspace pressure equalisation valve arrangement 62 sub-parts with respect to each other may create a small vent aperture and may enable the headspace pressure to be vented towards atmospheric pressure such that it may at least substantially equalise with atmospheric pressure at a pre-set and controlled rate dependent on the vent aperture size so formed and independent of a user thereby allowing safe and controlled venting of the headspace pressure, and for above atmospheric pressure applications, minimal generation of effervescence.

Once the headspace pressure has at least significantly equalised with atmospheric pressure the at least one headspace pressure lock arrangement 61 may release its headspace pressure lock sufficiently to enable the one-handed closure to be fully and freely opened and reclosed as required by a user, thereby enabling a user to freely open the closure into a "drink" position (not depicted) and drink the beverage through the substantially narrow drinking aperture 60. The opening into a "drink" position may be by means of the headspace pressure lock arrangement 61 releasing its jamming or locking such that the drinking aperture sealing plug 59 is on longer constrained from being rotated into the "drink" position.

For above atmospheric pressure applications, upon reclosing, any residual pressure in the beverage may lead to a re-build-up in pressure in the headspace such that the headspace pressure lock arrangement 61 may once again at least substantially engage and lock-closed the one-handed closure.

Additional means of sealing 63 may ensure that the closure for above or below atmospheric headspace pressure beverages with a substantially narrow drinking aperture that may be opened and reclosed by a user in substantially a one-handed manner 56 is suitable for multiple reuse.

A closure for above or below atmospheric headspace pressure beverages with a substantially narrow drinking aperture that may be opened and reclosed by a user in substantially a one-handed manner has thereby been formed.

Figure 10:
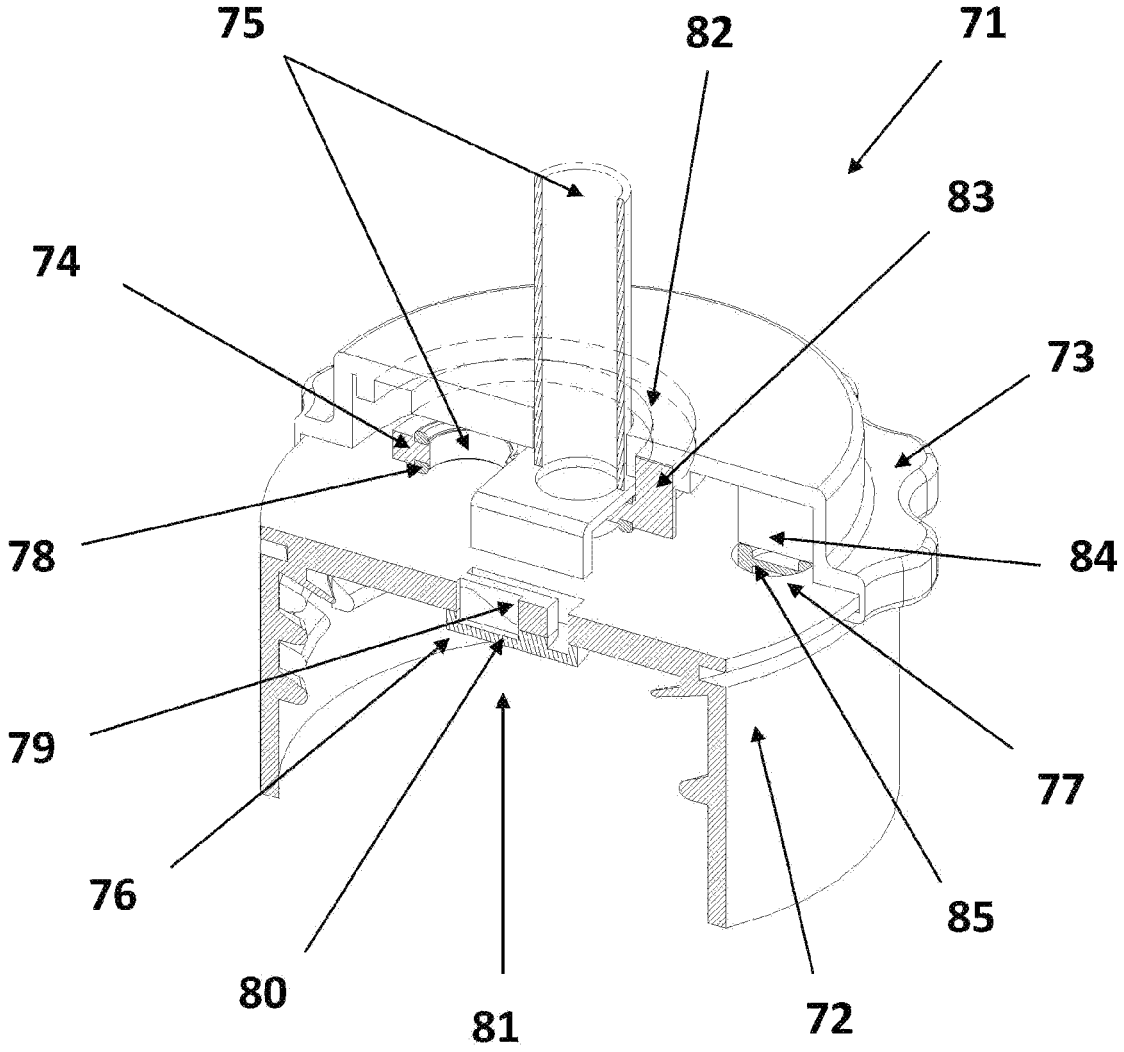
FIG. 10 shows a three-dimensional cross section view of a one-handed closure with substantially narrow drinking aperture and rotatable means of opening in a "sealed closed" position incorporating a cam sliding arrangement according to the same third preferred embodiment of the present invention.

Referring to FIG. 10, a closure for pressurised headspace beverages with a substantially narrow drinking aperture that may be opened and reclosed by a user in substantially a one-handed manner 71 is depicted in three-dimensional cross-section view in a "sealed closed" position including a main closure body arrangement 72 which includes the thread finish and means of pressure sealing when engaged onto a bottle thread finish (bottle thread finish not depicted), a rotatable means of opening and reclosing incorporating a cam slider mechanism arrangement 73, a drinking aperture sealing plug 74 that may slidingly open and reclose a substantially narrow drinking aperture 75, at least one headspace pressure lock arrangement 76, at least one controlled rate of release headspace pressure equalisation valve arrangement 77, and a sealing system suitable for multiple re-use 78.

The assembly may comprise one or more alternate materials either assembled as separate parts and/or over-moulded into an integral structure. As depicted, the main closure body arrangement 72 is an integral structure comprising at least one thermoplastic polymer part 79, typically polypropylene, and at least one thermoplastic elastomer part 80, typically a TPE or the like.

While the headspace is pressurised, the at least one headspace pressure lock arrangement 76 may at least substantially employ the use of the headspace pressure 81 itself to at least substantially ensure that the drinking aperture sealing plug 74 cannot freely be slidingly engaged into a "drink" position by a user. As depicted, this is achieved by means of the headspace pressure 81 applying pressure onto the at least one headspace pressure lock arrangement 76 such that the combination of the least one thermoplastic polymer part 79 and/or the at least one thermoplastic elastomer part 80 flex in such a way as to lockingly or jammingly restrict the drinking aperture sealing plug 74 from being slidingly engaged into a "drink" position.

It will be apparent to those versed in the art that by means of changes in the geometry, shape, form or design of the at least one headspace pressure lock arrangement 76, the at least one headspace pressure lock arrangement 76 may readily be optimized to function as a locking or jamming means for either above atmospheric headspace pressure and/or below atmospheric headspace pressure beverages.

While in this "sealed closed" position, the one-handed closure arrangement 71 is constrained from freely being opened into a "drink" position by a user.

The one-handed closure arrangement 71 may include mean of tamper-evidence (not depicted). The one-handed closure arrangement 71 may include means of hygiene protection (not depicted). The one-handed closure arrangement 71 may include means to inhibit removal of the closure from the bottle thread finish (not depicted).

Once any means of hygiene protection has been removed, the cam slider mechanism arrangement 73 may freely and rotatably be moved by a user sufficiently to in-turn slide the drinking aperture sealing plug 74 from a "sealed closed" into a "controlled vent" position (not depicted), however during this sliding movement into the "controlled vent" position the at least one headspace pressure lock arrangement 76 remains engaged, and thereby a user cannot freely further rotate/slide the one-handed closure arrangement 71 into a "drink" position due to the locking or jamming means of the at least one headspace pressure lock arrangement 76 remaining engaged.

The mechanical drive means of the substantially narrow drinking aperture 75 may be by means of a rotatable cam slider mechanism arrangement 73 (as depicted, with at least one cam 82 being an integral part of the rotatable cam slider mechanism arrangement 73 and at least one cam follower 83 being an integral part of the drinking aperture sealing plug 74). By means of the cam slider engagement of the at least one cam 82 and the at least one cam follower 83, when a user rotates the cam slider mechanism arrangement 73 they in-turn directly effect a sliding movement in the drinking aperture sealing plug 74.

Once the rotatable/slidable means of opening and reclosing incorporating a cam sliding mechanism arrangement 73 and thereby the drinking aperture sealing plug 74 have freely, rotatably and slidably been moved into a controlled vent position, the at least one controlled rate of release headspace pressure equalisation valve arrangement 77 is caused to transition from a "sealed closed" to a "controlled vent" position by means of the relative movement of the rotation/sliding action. The at least one controlled rate of release headspace pressure equalisation valve arrangement 77 may comprise thermoplastic polymer features 84 such as the likes of polypropylene as part of the cam sliding mechanism arrangement 73, and thermoplastic elastomer features 85 such as the likes of TPE as part of the main closure body arrangement 72.

The relative movement of the at least one controlled rate of release headspace pressure equalisation valve arrangement 77 sub-parts with respect to each other may create a small vent aperture and may enable the headspace pressure to be vented towards atmospheric pressure such that it may at least substantially equalise with atmospheric pressure at a pre-set and controlled rate dependent on the vent aperture size so formed and independent of a user thereby allowing safe and controlled venting of the headspace pressure, and for above atmospheric pressure applications, minimal generation of effervescence.

Once the headspace pressure has at least significantly equalised with atmospheric pressure the at least one headspace pressure lock arrangement 76 may release its headspace pressure lock sufficiently to enable the one-handed closure to be fully and freely opened and reclosed as required by a user, thereby enabling a user to freely open the closure into a "drink" position (not depicted) and drink the beverage through the substantially narrow drinking aperture 75. The opening into a "drink" position may be by means of the headspace pressure lock arrangement 76 releasing its jamming or locking such that the drinking aperture sealing plug 74 is on longer constrained from being slidingly engaged into the "drink" position.

For above atmospheric pressure applications, upon reclosing, any residual pressure in the beverage may lead to a re-build-up in pressure in the headspace such that the headspace pressure lock arrangement 76 may once again at least substantially engage and lock-closed the one-handed closure.

Additional means of sealing 78 may ensure that the closure for above or below atmospheric headspace pressure beverages with a substantially narrow drinking aperture that may be opened and reclosed by a user in substantially a one-handed manner 71 is suitable for multiple reuse.

A closure for above or below atmospheric headspace pressure beverages with a substantially narrow drinking aperture that may be opened and reclosed by a user in substantially a one-handed manner has thereby been formed.

Figure 11:
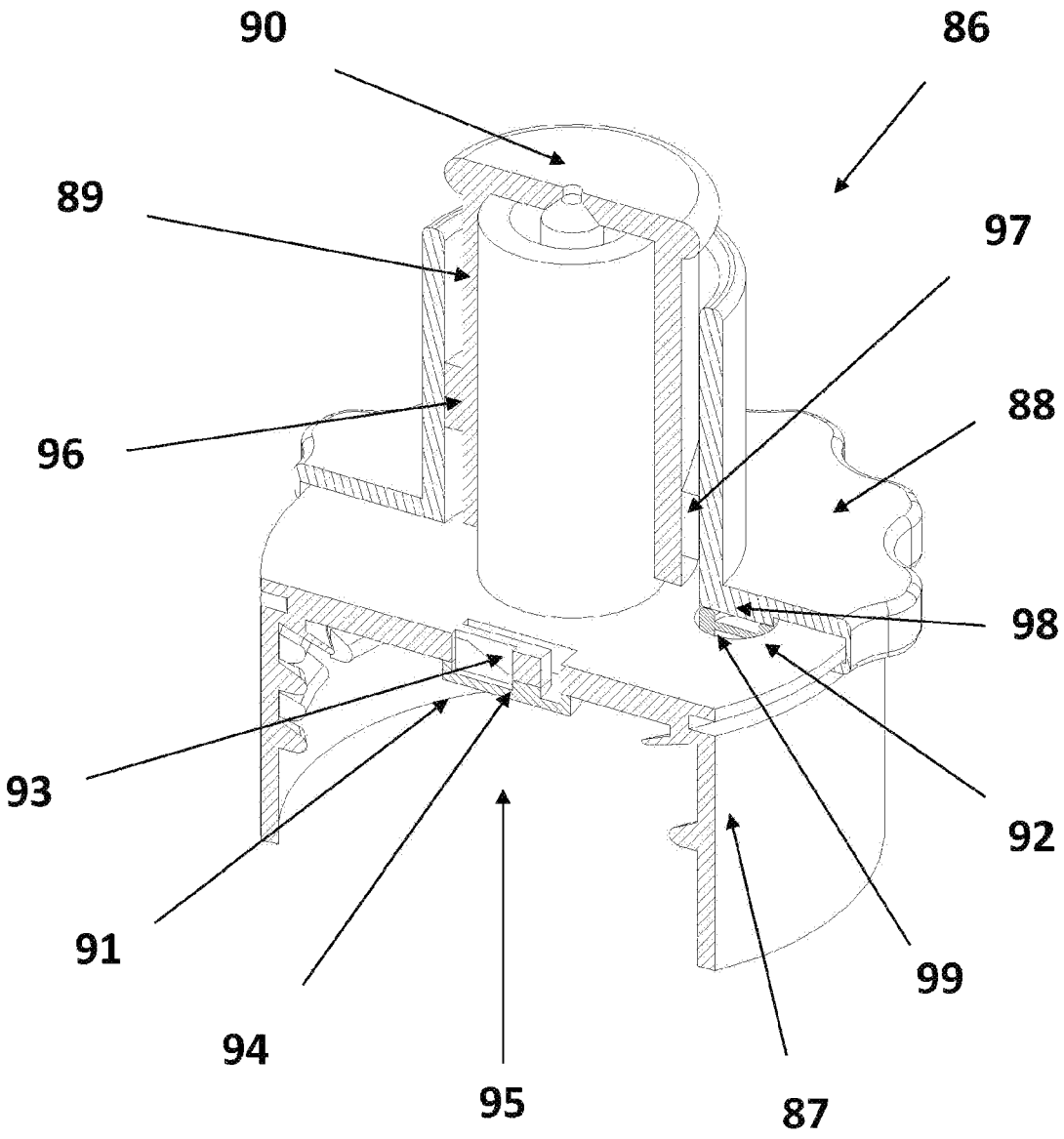
FIG. 11 shows a three-dimensional cross section view of a one-handed closure with substantially narrow drinking aperture and rotatable means of opening in a "sealed closed" position incorporating a spout arrangement according to the same third preferred embodiment of the present invention.

Referring to FIG. 11, a closure for pressurised headspace beverages with a substantially narrow drinking aperture that may be opened and reclosed by a user in substantially a one-handed manner 86 is depicted in three-dimensional cross-section view in a "sealed closed" position including a main closure body arrangement 87 which includes the thread finish and means of pressure sealing when engaged onto a bottle thread finish (bottle thread finish not depicted), a rotatable means of opening and reclosing incorporating a spout-locking arrangement 88, a drinking spout 89 that may open and reclose a substantially narrow drinking aperture 90, at least one headspace pressure lock arrangement 91, at least one controlled rate of release headspace pressure equalisation valve arrangement 92, and a sealing system suitable for multiple re-use (not depicted).

The assembly may comprise one or more alternate materials either assembled as separate parts and/or over-moulded into an integral structure. As depicted, the main closure body arrangement 87 is an integral structure comprising at least one thermoplastic polymer part 93, typically polypropylene, and at least one thermoplastic elastomer part 94, typically a TPE or the like.

While the headspace is pressurised, the at least one headspace pressure lock arrangement 91 may at least substantially employ the use of the headspace pressure 95 itself to at least substantially ensure that the drinking spout 89 cannot readily be pullingly opened or mechanically driven open into a "drink" position by a user. As depicted, this is achieved by means of the headspace pressure 95 applying pressure onto the at least one headspace pressure lock arrangement 91 such that the combination of the least one thermoplastic polymer part 93 and/or the at least one thermoplastic elastomer part 94 flex in such a way as to lockingly or jammingly restrict the rotation of the rotatable means of opening and reclosing incorporating a spout-locking arrangement 88. As depicted, this may be achieved by means of at least one cam follower feature 96 on the drinking spout 89 and at least one cam feature 97 on the rotatable means of opening and reclosing incorporating a spout-locking arrangement 88 which together constrain the drinking spout 89 from being pullingly opened or mechanically driven open into a "drink" position by means of the cam arrangement so formed.

It will be apparent to those versed in the art that by means of changes in the geometry, shape, form or design of the at least one headspace pressure lock arrangement 91, the at least one headspace pressure lock arrangement 91 may readily be optimized to function as a locking or jamming means for either above atmospheric headspace pressure and/or below atmospheric headspace pressure beverages.

While in this "sealed closed" position, the one-handed closure arrangement 86 is constrained from freely being opened into a "drink" position by a user.

The one-handed closure arrangement 86 may include mean of tamper-evidence (not depicted). The one-handed closure arrangement 86 may include means of hygiene protection (not depicted). The one-handed closure arrangement 86 may include means to inhibit removal of the closure from the bottle thread finish (not depicted).

Once any means of hygiene protection has been removed, the rotatable means of opening and reclosing incorporating a spout-locking arrangement 88 may freely and rotatably be moved by a user sufficiently to transition the one-handed closure arrangement 86 from a "sealed closed" into a "controlled vent" position (not depicted), however during this rotating movement into the "controlled vent" position the at least one headspace pressure lock arrangement 91 remains engaged, and thereby a user cannot freely further rotate the one-handed closure arrangement 86 into a "drink" position due to the locking or jamming means of the at least one headspace pressure lock arrangement 91 remaining engaged.

Once the one-handed closure arrangement 86 has been rotatably transitioned into a controlled vent position, the at least one controlled rate of release headspace pressure equalisation valve arrangement 92 is caused to transition from a "sealed closed" to a "controlled vent" position by means of the relative movement of the rotating action. The at least one controlled rate of release headspace pressure equalisation valve arrangement 92 may comprise thermoplastic polymer features 98 such as the likes of polypropylene as part of the rotatable means of opening and reclosing incorporating a spout-locking arrangement 88, and thermoplastic elastomer features 99 such as the likes of TPE as part of the main closure body arrangement 87.

The relative movement of the at least one controlled rate of release headspace pressure equalisation valve arrangement 92 sub-parts with respect to each other may create a small vent aperture and may enable the headspace pressure to be vented towards atmospheric pressure such that it may at least substantially equalise with atmospheric pressure at a pre-set and controlled rate dependent on the vent aperture size so formed and independent of a user thereby allowing safe and controlled venting of the headspace pressure, and for above atmospheric pressure applications, minimal generation of effervescence.

Once the headspace pressure has at least significantly equalised with atmospheric pressure the at least one headspace pressure lock arrangement 91 may release its headspace pressure lock sufficiently to enable the one-handed closure to be fully and freely opened and reclosed as required by a user, thereby enabling a user to freely open the closure into a "drink" position (not depicted) and drink the beverage through the substantially narrow drinking aperture 90. The opening into a "drink" position may be by means of the headspace pressure lock arrangement 91 releasing its jamming or locking such that the rotatable means of opening and reclosing incorporating a spout-locking arrangement 88 is on longer constrained from being rotated sufficiently to release is lock on the drinking spout 89. The drinking spout 89 may then be either freely pulled by a user or mechanically driven by the cam arrangement into the "drink" position.

For above atmospheric pressure applications, upon reclosing, any residual pressure in the beverage may lead to a re-build-up in pressure in the headspace such that the headspace pressure lock arrangement 91 may once again at least substantially engage and lock-closed the one-handed closure.

Additional means of sealing (not depicted) may ensure that the closure for above or below atmospheric headspace pressure beverages with a substantially narrow drinking aperture that may be opened and reclosed by a user in substantially a one-handed manner 86 is suitable for multiple reuse.

A closure for above or below atmospheric headspace pressure beverages with a substantially narrow drinking aperture that may be opened and reclosed by a user in substantially a one-handed manner has thereby been formed.

It will thus be seen that the present invention provides a one-handed closure where a user is constrained from drinking the beverage until the headspace pressure is at least substantially near atmospheric, the closure is suitable for multiple re-use and the venting of headspace pressure towards atmospheric pressure occurs in a safe and controlled manner.

It will be apparent to anyone versed in the art that this invention can be readily modified and adapted based on other similar and known closure forms and further that the headspace pressure lock arrangement and headspace pressure equalisation valve arrangement may be readily integrated into many other systems other than closures where the safe and controlled release of pressure is an issue.

A closure that may be opened and reclosed by a user in substantially a one-handed manner may comprise at least one or more of the following:

- be suitably optimised for above atmospheric headspaces,
- be suitable optimized for below atmospheric headspaces,
- have a substantially wide drinking aperture,
- have a substantially narrow drinking aperture,
- have at least one headspace pressure lock arrangement between any two or more sub-assembly parts that move relative to each other during opening and closing actions,
- have at least one headspace pressure equalisation valve arrangement between any two or more sub-assembly parts that move relative to each other during opening and closing actions,
- have means of tamper-evidence,
- have means of hygiene protection,
- have means to inhibit removal of the closure from the bottle thread finish,
- have means of over-pressure relief,
- any combination of the above.

Where in the foregoing description reference has been made to integers or components having known equivalents, then such equivalents are herein incorporated as if individually set forth.

Although this invention has been described by way of example and with reference to possible embodiments thereof, it is to be appreciated that improvements and/or modifications may be made thereto without departing from the scope or spirit of the invention.

The invention claimed is:

1. A pressurized headspace closure for a beverage container that may be opened and reclosed by a user in at least substantially a one-handed manner, comprising (a) a closure body containing a drinking aperture, (b) at least one headspace pressure lock mechanism connected with said closure body and operable using the headspace pressure to prevent the closure from being opened by a user where a headspace pressure is at least substantially above or below atmospheric pressure, (c) at least one controlled-rate headspace pressure equalization valve assembly including an aperture defined in said closure body and a valve plug rotatably connected with said body and operable to vent the headspace pressure via said aperture to substantially equalize the headspace pressure with the atmospheric pressure at a pre-set and controlled rate independent of the user, thereby to allow safe and controlled venting of the headspace pressure; and (d) a sealing system connected with said closure body and suitable for multiple re-use, whereby after the headspace pressure has at least substantially equalized with the atmospheric pressure, the headspace pressure lock system is sufficiently released to enable the one-handed closure to be freely opened and reclosed as required by the user, thereby enabling the user to freely open and access a beverage through said drinking aperture.

2. The headspace pressure closure according to claim 1, wherein said drinking aperture is substantially wide.

3. The headspace pressure closure according to claim 1, wherein said drinking aperture is substantially narrow.

4. The headspace pressure closure according to claim 1, wherein said at least one headspace pressure lock mechanism and said at least one controlled-rate headspace pressure equalization valve assembly are optimized for above atmospheric headspace pressures.

5. The headspace pressure closure according to claim 1, wherein said at least one headspace pressure lock mechanism and said at least one controlled-rate headspace pressure equalization valve assembly are optimized for below atmospheric headspace pressures.

6. The headspace pressure closure according to claim 1, wherein said at least one headspace pressure lock mechanism when in a locked condition prevents the closure from being opened into a drink position but allows the closure to be opened into a controlled vent position.

7. The headspace pressure closure according to claim 1, wherein said at least one headspace pressure lock mechanism includes components of at least two closure sub-assemblies that move with respect to each other during opening and closing of the closure.

8. The headspace pressure closure according to claim 1, wherein said at least one controlled-rate headspace pressure equalization valve assembly includes components of at least two closure sub-assemblies that move with respect to each other during opening and closing of the closure.

9. The headspace pressure closure according to claim 1, and further comprising a headspace over-pressure relief valve mechanism operable when the headspace pressure rises above a pre-set maximum level.

10. The headspace pressure closure according to claim 1, and further comprising tamper-evidence.

11. The headspace pressure closure according to claim 1, and further comprising hygiene protection.

12. The headspace pressure closure according to claim 1, wherein removal of the closure from the thread finish of the beverage container is constrained.

* * * * *